US008317026B2

(12) United States Patent
Loftin et al.

(10) Patent No.: US 8,317,026 B2
(45) Date of Patent: Nov. 27, 2012

(54) CHILD RESISTANT BLISTER PACKAGE HOUSING WITH TOOLED ACCESS

(75) Inventors: Caleb S Loftin, Raleigh, NC (US); William Roger Rigby, Spring Hope, NC (US)

(73) Assignee: MeadWestvaco Corporation, Richmond, VA (US)

( * ) Notice: Subject to any disclaimer, the term of this patent is extended or adjusted under 35 U.S.C. 154(b) by 92 days.

(21) Appl. No.: 12/473,245

(22) Filed: May 27, 2009

(65) Prior Publication Data

US 2009/0308775 A1 Dec. 17, 2009

Related U.S. Application Data

(60) Provisional application No. 61/056,252, filed on May 27, 2008, provisional application No. 61/056,250, filed on May 27, 2008, provisional application No. 61/056,255, filed on May 27, 2008, provisional application No. 61/058,321, filed on Jun. 3, 2008.

(51) Int. Cl.
*B65D 83/04* (2006.01)

(52) U.S. Cl. ..... 206/531; 206/532; 206/469

(58) Field of Classification Search ..... 206/538, 206/534, 532, 531, 539, 469, 528; 229/207, 229/208, 243; 220/269
See application file for complete search history.

(56) References Cited

U.S. PATENT DOCUMENTS

| | | | | |
|---|---|---|---|---|
| 2,936,937 | A * | 5/1960 | Guyer | 225/48 |
| 4,919,785 | A * | 4/1990 | Willey et al. | 229/207 |
| 5,091,261 | A | 2/1992 | Casey et al. | |
| 5,172,812 | A | 12/1992 | Wharton et al. | |
| 5,339,960 | A | 8/1994 | Price | |
| 5,927,500 | A | 7/1999 | Godfrey et al. | |
| 5,996,886 | A * | 12/1999 | Evert | 229/243 |
| 6,010,784 | A | 1/2000 | Peterson | |
| 6,338,407 | B2 | 1/2002 | Danville | |
| 7,051,876 | B2 | 5/2006 | Grosskopf | |
| 7,144,635 | B2 | 12/2006 | Hawes et al. | |
| 7,401,702 | B2 | 7/2008 | Hession | |
| 7,464,818 | B2 | 12/2008 | Gherdan et al. | |
| 7,726,486 | B2 | 6/2010 | Jones | |
| 2002/0100709 | A1 * | 8/2002 | Shibata | 206/469 |
| 2003/0234203 | A1 | 12/2003 | Urban et al. | |
| 2006/0289328 | A1 * | 12/2006 | Hession | 206/531 |
| 2007/0221534 | A1 | 9/2007 | Intini | |
| 2008/0155941 | A1 * | 7/2008 | Williams-Hartman | 53/128.1 |
| 2009/0288978 | A1 | 11/2009 | Prud'Homme | |
| 2010/0108677 | A1 | 5/2010 | Loftin et al. | |

FOREIGN PATENT DOCUMENTS

| | | |
|---|---|---|
| EP | 0847921 | 6/1998 |

* cited by examiner

*Primary Examiner* — David Fidei
(74) *Attorney, Agent, or Firm* — MWV Intellectual Property Group

(57) ABSTRACT

A child-resistant package including two panels having one or more blister apertures and a particular manner of accessing the product within the blister apertures. One manner of accessing the product involves applying pressure to punch tabs defined by staggered perforations. Another manner of accessing the product uses tooled access slots designed to receive a tool to peel away tab strips to facilitate product access. Yet another manner of accessing utilizes tab strips, one or more folding lines and one or more crevice forming lines where the crevice forming lines are designed to receive a tool used to obtain access to the tab strips, and thus, facilitate access to the products. Still another uses dual tabs that need to be sequentially peeled away from the child resistant package housing to facilitate access to the product contained.

15 Claims, 21 Drawing Sheets

CHILD RESISTANT BLISTER PACKAGE HOUSING WITH TOOLED ACCESS

BACKGROUND OF THE INVENTION

Field of the Invention

The present invention relates generally to child resistant blister packaging for the packaging and dispensing of articles. More specifically, the present invention is directed to a package including a child resistant blister package housing for encapsulating one or more blister packages and allowing controlled and child-resistant packaging and dispensing of articles.

It is known that blister packaging can be used to store and deliver a wide range of items. Among the many types of items that can be stored and delivered in blister packs are pharmaceutical products, such as tablets, pills, capsules, and other related items. Conventional blister packages include a blister tray that is typically a thermoformed plastic sheet with a plurality of blister cells or depressions formed therein. Typically, after items are placed in the cells, the items are retained and protected in the respective cells by securing a backing sheet to the blister tray. The backing sheet is often a thin layer of metal foil, plastic, paperboard, or other material secured to the back of the blister tray, thereby sealing the cells. In other types of blister packages, the contents are placed in substantially puncture-proof foil containers that can be covered with foil or paperboard backing.

In many blister packages, the foil backing is thin enough to be punctured mechanically, or ruptured by pressing the blister so that the encapsulated item penetrates the foil backing. If the backing sheet is made from, for example, paperboard, or similar material, then the backing often includes gates in the backing sheet that cover the openings of respective blister cells. In practice, each gate is deformed or manipulated so that it ruptures or partially separates from the surrounding paperboard to allow the item contained within the blister cell to be pushed out of the blister cell for use.

While the conventional blister packaging is viewed by many to be suitable for most applications, there are several design deficiencies. The conventional packages provide removal of the items from the blister cells, but offer little in the way of resisting child tampering. Child resistance is a feature that is desired, particularly for dose pharmaceutical packaging.

To address the desirability of child resistance, many blister packaging designs employ materials of increased rigidity, compared to conventional non-child-resistant packages. For example, in increased-rigidity packages, the backing sheet and/or the blister cells can be made thicker and/or more resistant to pressure. As such, a young child is unlikely to be able to generate the pressure required to force the package contents through the increased-strength materials. In addition to the benefits in terms of child resistance, increased rigidity can provide additional protection for the enclosed materials, which may be, as is the case with pharmaceuticals, fragile and susceptible to breakage.

BRIEF SUMMARY OF THE INVENTION

The invention includes a novel packaging blank designed to be formable into a package capable of containing a product. The package so formed is child resistant by having a construction making it difficult for the product to be removed from the package because a tab strip is in place on the package in a position blocking the exit of the product from the package.

The package is designed in such a way as to permit a folding action that will create next to the tab strip a crevice designed to receive a tool. The tool is then positioned within the crevice and the package is again folded, but in the opposite direction. This time the folding action, using the tool as leverage, results in the application of force to the package in a way that slightly tears the tab strip from the package. At that point, the user can grasp the tab strip and partially or completely remove it from the package. With the tab strip no longer in place, the product is more easily removed from the package.

Because the invention requires (1) a tool, (2) a folding action to create a crevice for receiving the tool, and (3) another folding action using the tool as leverage, a young child would face substantial resistance in trying to gain access to the product. Such a child may not have possession of such a tool and may not even realize that a tool is needed. The child also may not realize that an initial folding motion is needed to create the crevice within which the tool is to be placed. Moreover, the child may not understand the type of folding motion needed to apply correctly the force needed to make the tab strip graspable. At the same time, the child-resistant nature of the invention does not deny product access to persons with diminished motor skills, strength, or both. Such persons will be able to use the tool successfully with relatively little effort and subsequently obtain the product from the package.

Another invention includes "presently disclosed" a novel packaging blank designed to be formable into a package capable of containing a product. The package so formed is child resistant by having a construction making it difficult for the product to be removed from the package because a tab strip is in place on the package in a position blocking the exit of the product from the package. Next to the tab strip is a slot designed to receive a tool. The tool is used to apply force to the package in a way that slightly tears the package, thereby letting the user grasp the tab strip and partially or completely remove the tab strip from the package. With the tab strip no longer in place, the product is more easily removed from the package.

Because the invention requires the use of a tool for easily removing the product from the package, a young child would face substantial resistance in trying to gain access to the product. Such a child may not have possession of such a tool and may not even realize that a tool is needed. The child also may not understand the type of motion needed to apply correctly the force needed to make the tab strip graspable. At the same time, the child-resistant nature of the invention does not deny product access to persons with diminished motor skills, strength, or both. Such persons will be able to use the tool successfully with relatively little effort and subsequently obtain the product from the package.

Another disclosed invention includes a novel packaging blank designed to be formable into a package capable of containing a product. The package so formed is child resistant by having a construction making it difficult for the product to be removed from the package because a tab strip is in place on the back of the package in a position blocking the exit of the product from the package. Prior to grasping that tab strip, another tab strip on the front of the package must be completely or partially removed. Removing the front tab strip creates an aperture through which the back tab strip can be reached. The user then grasps the back tab strip and partially or completely removes it from the package. With the back tab strip no longer in place, the product is more easily removed from the package.

Because the invention requires the pulling of two tabs from the package prior to obtaining the product, a young child would face substantial resistance in trying to gain access to the product. Such a child may not even realize that removing the tabs is necessary. At the same time, the child-resistant nature of the invention does not deny product access to persons with diminished motor skills, strength, or both. Such persons will be able to remove the two tabs successfully with relatively little effort and subsequently obtain the product from the package.

DETAILED DESCRIPTION OF THE INVENTION

As required, detailed embodiments of the present invention are disclosed herein. It is to be understood that the disclosed embodiments are merely exemplary of the invention that may be embodied in various and alternative forms, and combinations thereof. As used herein, the word "exemplary" is used expansively to refer to embodiments that serve as an illustration, specimen, model or pattern. As used herein, the terms "foldable score line" and "severance line" refer to all manner of lines indicating optimal fold or cut locations, frangible or otherwise weakened lines, perforations, a line of perforations, a line of short slits, a line of half-cuts, a single half-cut, a cut line, scored lines, slits, any combination thereof, and the like.

The figures are not necessarily to scale and some features may be exaggerated or minimized to show details of particular components. In other instances, well-known components, systems, materials or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

It is contemplated that the present invention is not limited to the pharmaceutical products and personal-healthcare-related articles referenced with the illustrated embodiment. Instead, embodiments of packaging made in accordance with the present invention can have application in packaging for any small, delicate, sensitive, or portable article. Furthermore, the packaging can be used for larger items as a method of decreasing the incidence of product theft. Examples of articles for which such packaging can be employed include all manner of consumable products such as candy, food, vitamins, tobacco, and the like; all manner of personal-care products such as contact lenses, birth-control devices, smoking-cessation patches, hearing-aid batteries, and the like; as well as any item that can fit within a portable container.

Figure 1:
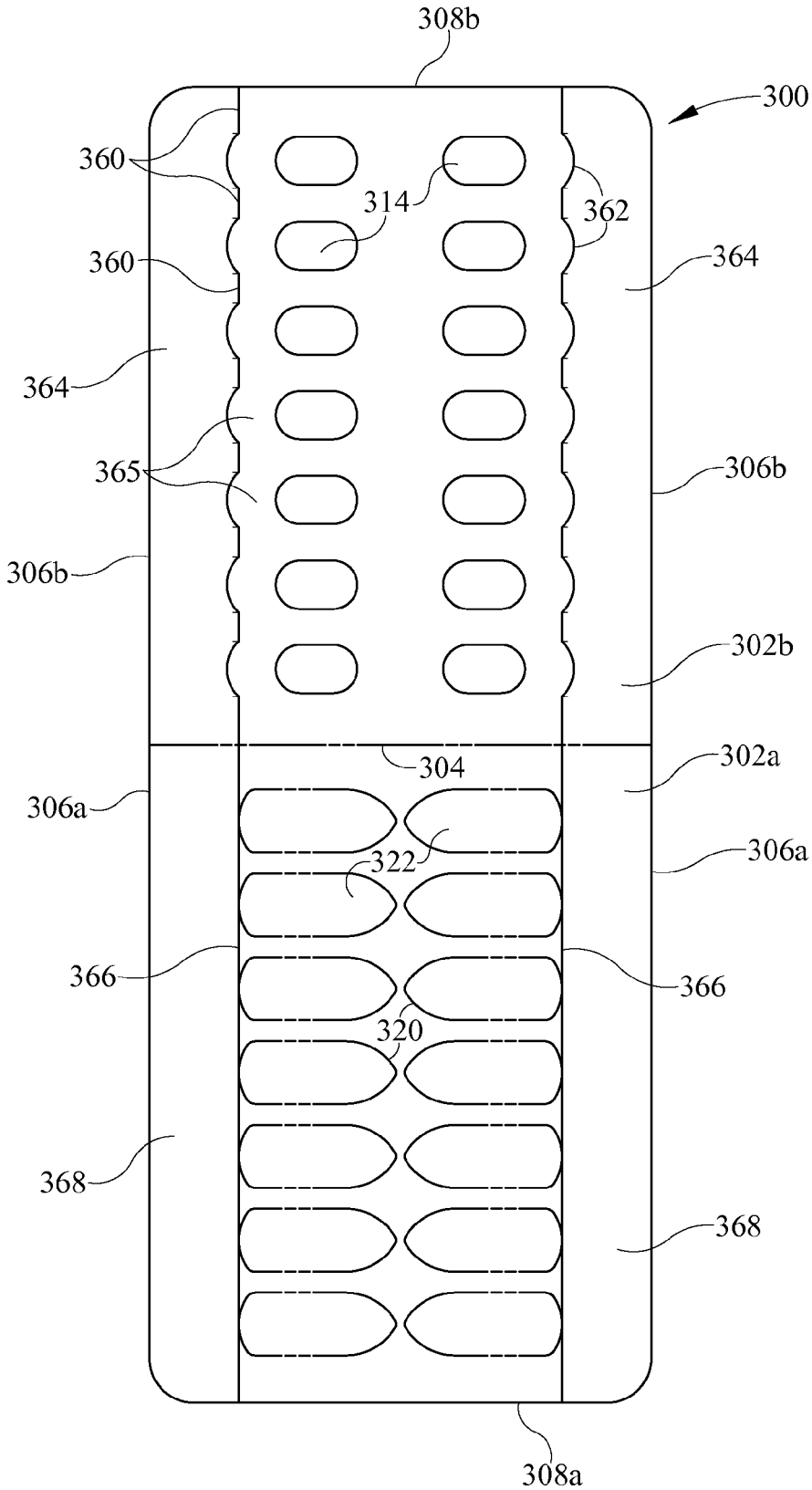
FIG. 1 is a plan view of an exemplary packaging blank, according to an embodiment of the present invention.

Referring now to the drawings, wherein like elements are represented by like numerals, FIG. 1 is a plan view of an exemplary packaging blank 300 made according to the present invention.

The packaging blank 300 includes a back panel 302*a* and a face panel 302*b*. The face panel 302*b* and the back panel 302*a* are hingedly connected along a foldable score line 304. The back panel 302*a* has two back panel side edges 306*a* and a back panel bottom edge 308*a*. The face panel 302*b* has two face panel side edges 306*b* and a face panel top edge 308*b*. Although in this exemplary embodiment, the panels 302*a* and 302*b* are illustrated as integrally formed as one piece, it should be understood that the respective panels 302*a* and 302*b* can be formed as two separate and distinct pieces.

The packaging blank 300 can be constructed from any suitable substrate material. Suitable substrate materials include, but are not limited to, plastics, conventional paperboard, including solid bleached sulfate (SBS) paperboard of suitable weight, size and shape, and combinations thereof. Commercial examples of suitable substrate include EASY SEAL® and EASY SEAL PLUS® self-sealing boards, both of which are currently available from MeadWestvaco Corporation. Additionally, it is contemplated that embodiments of the present invention may be used in conjunction with NATRALOCK® and ENDURANCE PTHS® packaging systems. Additionally, a tear-resistant layer may or may not be adhered to the packaging blank 300. Tear-resistant layers, if included, are often laminated to the blank before cutting. Furthermore, it is possible that an abhesive layer or material may be added to the packaging blank 300 prior to assembling the packaging blank 300 into a package, as will be explained below. The abhesive layer serves to nullify adhesive properties that may be present on the surface of packaging blank 300. The packaging blank 300 may also be an unbleached board, depending on the desired appearance of the final package.

The back panel 302*a* further includes severance lines 320 and tab strips 322. The severance lines 320, which define tab strips 322, can be shaped and dimensioned to allow removal of material by interfacing with a tool in a method that will be described in more detail below. The tab strips 322 can have any desired shape and dimensions. For example, the back panel 302*a* can be configured to include gates (not shown) that can be left after a tab strip 322 is removed. The back panel 302*a* further includes back panel folding lines 366. Severance lines of various types, including creases, may serve as back panel folding lines 366. The back panel folding lines 366 may intersect with severance lines 320, as shown in FIG. 1. Alternatively, back panel folding lines 366 may be slightly offset from severance lines 320 so long as the two lines are sufficiently close to permit leveraging action to be performed by a tool as described in more detail below. The material between back panel side edge 306*a*, back panel folding line 366, foldable score line 304, and back panel bottom edge 308*a* constitutes a back panel folding flap 368.

Figure 2:
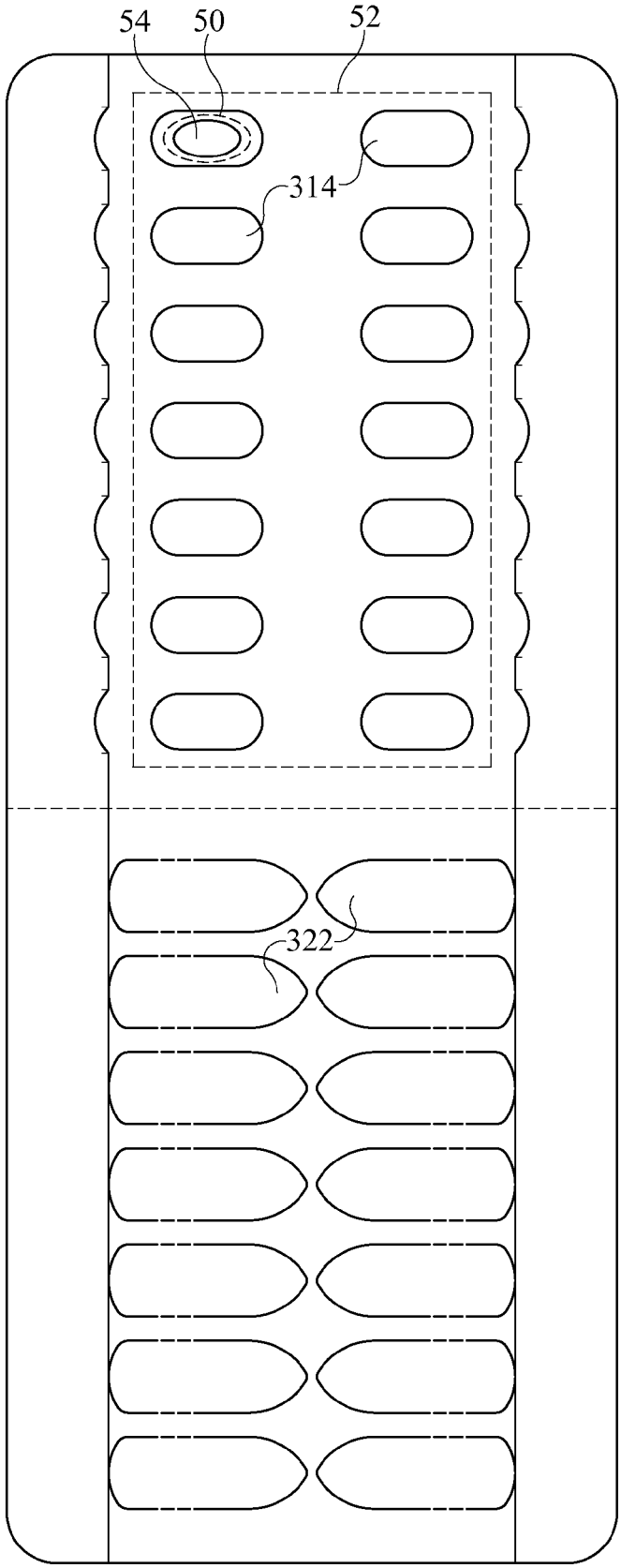
FIG. 2 is a plan view of an exemplary packaging blank including a blister pack, according to an embodiment of the present invention.

The face panel 302*b* further includes blister apertures 314, face panel folding lines 360, and crevice-forming lines 362. Severance lines of various types may serve as face panel folding lines 360 and crevice-forming lines 362. In one embodiment of the invention, creases are used as face panel folding lines 360 and slits are used as crevice-forming lines 362. As shown in FIG. 1, crevice-forming lines 362 may be curved in a crescent shape, but other orientations may also be used. The face panel folding lines 360 and crevice-forming lines 362 may sequentially intersect with each other in the manner shown in FIG. 1. Alternatively, small spaces may be present between face panel folding lines 360 and crevice-forming lines 362. As used herein, the term "substantially intersecting" includes formations in which face panel folding lines 360 and crevice-forming lines 362 either intersect or are located near each other with only small spaces present between them. The material between face panel side edge 306*b*, the substantially intersecting face panel folding lines 360 and crevice-forming lines 362, foldable score line 304, and face panel top edge 308*b* constitutes a face panel folding flap 364. The material between blister apertures 314 and crevice-forming lines 362 constitutes leverage zones 365. The blister apertures 314 are shaped and dimensioned to receive the blisters 50 of a blister pack 52, as shown in FIG. 2. As illustrated, one or more blisters 50 can contain a product 54, illustrated in FIG. 2 as a capsule of medication. The blister pack 52 has a backing sheet sufficiently thin to permit product 54 to be pushed through the backing with relatively low effort if no other layer (e.g., tab strip 322) is present.

Although FIGS. 1-2 are shown with two columns of blister apertures and tab strips, other layouts are also contemplated. For example, the present invention includes a single column of blister apertures and tab strips. Alternatively, in the two-column layout, the face panel folding lines and crevice-forming lines may be placed in between the two columns of blister apertures and the back panel folding lines may be placed in between the two columns of tab strips. In another embodiment, the packaging blank includes a single blister aperture, tab strip, back panel folding line, crevice-forming line, and face panel folding line. These alternatives are presented not as a limitation but are exemplary of the many embodiments of the present invention.

Figure 3:
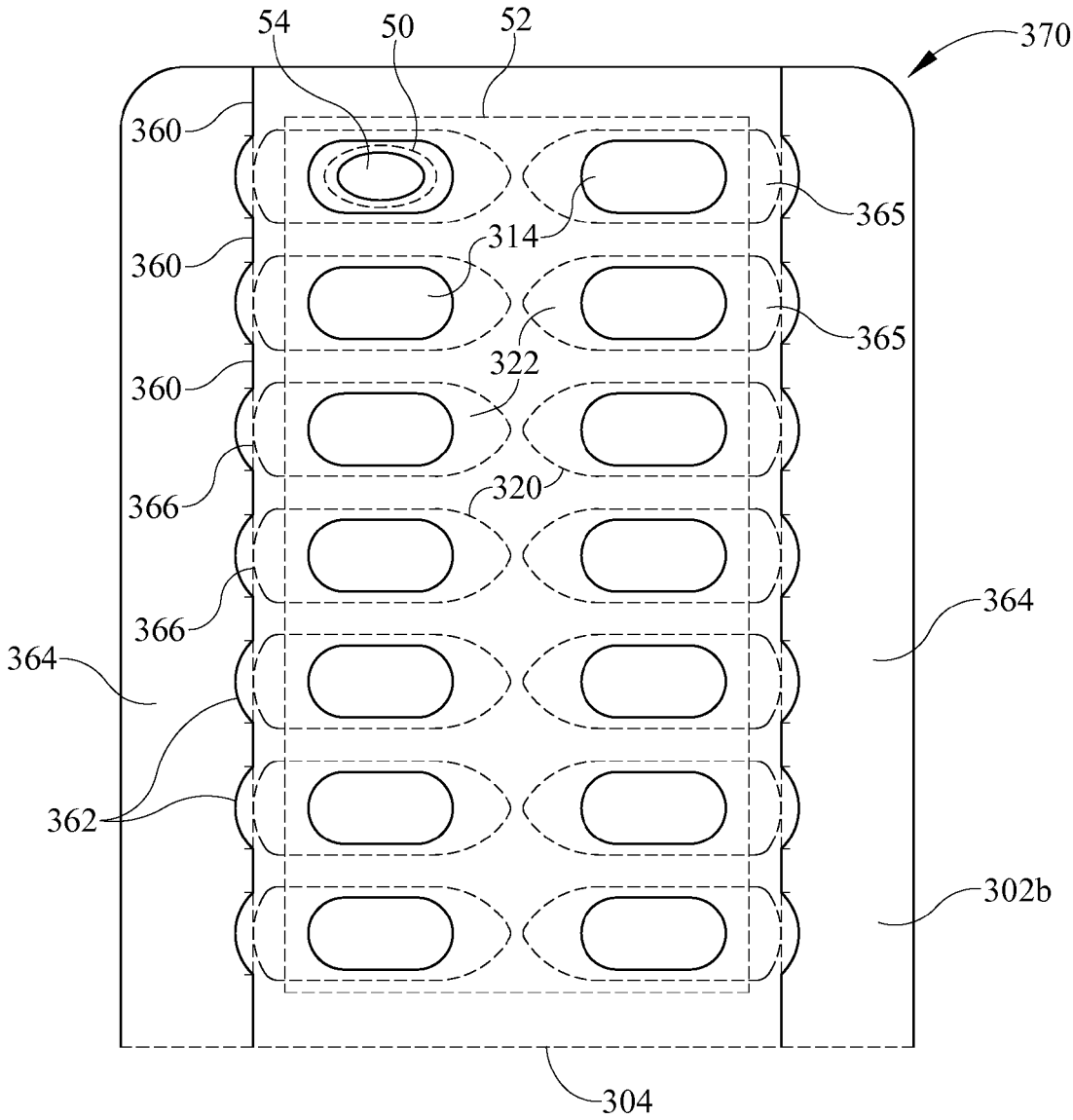
FIG. 3 is a plan view of an exemplary package, made from the packaging blank of FIG. 2.
Figure 4:
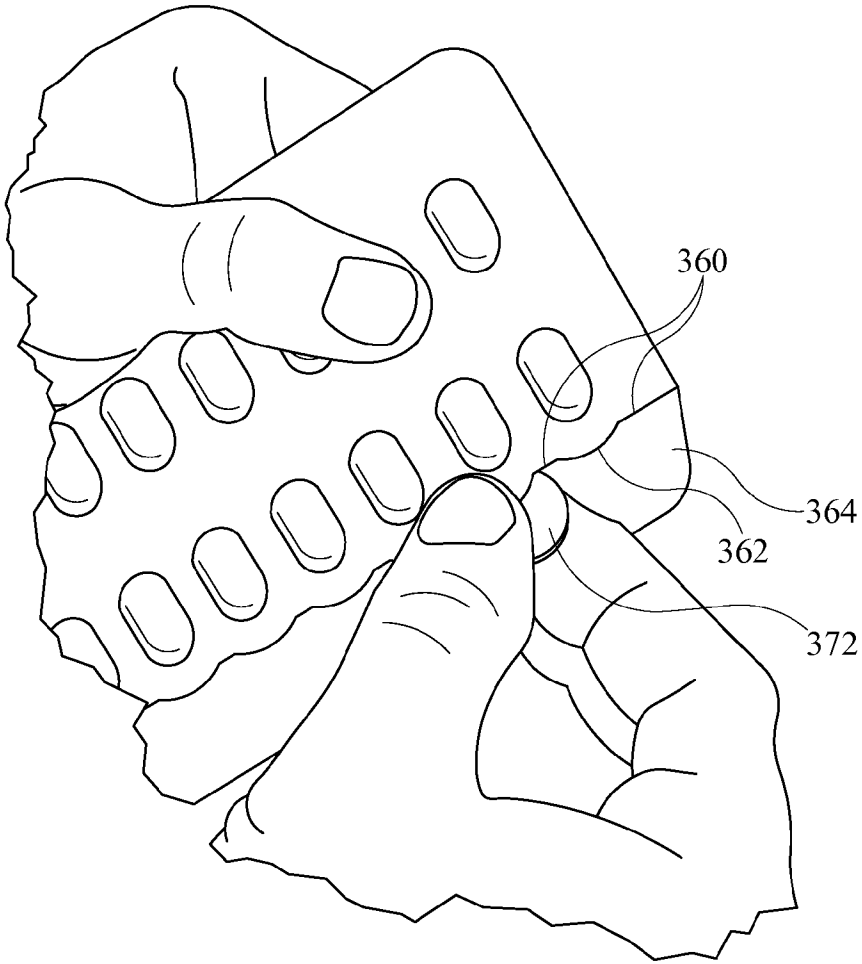
FIG. 4 illustrates a method for accessing products packaged in the exemplary package of FIG. 3.

With additional reference now to FIGS. 3-4, a package 370, made from packaging blank 300, is shown. A package 370 is formed by inserting the blisters 50 of a blister pack 52 into respective blister apertures 314, such that the blisters 50 protrude from the face panel 302*b*. After the blister pack 52 is in position, the packaging blank 300 can be folded into a face contacting arrangement, and secured. To fold the packaging blank 300, the facing surfaces of the back panel 302*a* and the face panel 302*b* are brought toward each other by folding along foldable score line 304. In completing the folding step, the tab strips 322 are aligned with respective blister apertures 314, and thereby with blisters 50 of blister pack 52, and are also aligned with respective leverage zones 365. Tab strips 322 are of sufficient thickness to impart child-resistance qualities to package 370 by making it difficult for product 54 to be removed from package 370 by merely applying pressure to blister 50. After the packaging blank 300 is folded, the back panel folding lines 366 and face panel folding lines 360 are aligned. The face panel 302*b* and the back panel 302*a* can be secured to one another, and the blister pack 52 can thereby be held in place, using any desired means or methods, which are well known to those of ordinary skill in the package housing art.

In practice, to access an item 54 from a package 370, with face panel 302*b* facing the user, the user grasps the face panel folding flap 364 and back panel folding flap 368 secured thereto located closest to desired item 54 and folds the two flaps away from the user along face panel folding lines 360 and back panel folding line 366. This folding action results in the formation of a crevice at the location of crevice-forming line 362. The crevice is of sufficient size to receive tool 372, illustrated in FIG. 4 as a penny. Other commonly available items, including but not limited to other types of coins, keys, flathead screwdrivers, knives, letter openers, and the like, may also function as tool 372.

After the user inserts tool 372 into the crevice, tool 372 becomes lodged in between tab strip 322 and leverage zone 365 corresponding to desired item 54. Once inserted, the user holds tool 372 in place while folding face panel folding flap 364 and back panel folding flap 368 secured thereto towards the user as shown in FIG. 4. During such a folding motion, one part of tool 372 is pressed against tab strip 322 while another part is pressed against leverage zone 365. This arrangement permits the user to use the material of leverage zone 365 as leverage for pressing against tab strip 322. Most adults will find such a motion to be very easy and natural. The folding motion, which may or may not need to be repeated, eventually partially tears severance line 320. Once severance line 320 has been partially torn, the user will be able to grasp tab strip 322 and peel it up from back panel 302*a* and away from the back panel folding line 366 closer to the tab strip being peeled. As tab strip 322 is peeled, it separates from back panel 302*a* along severance line 320. The severance line 320 permits the user to tear most or all of tab strip 322 from package 370, such that there is adequate access to allow product 54 to pass out of package 370. The user can then apply force to the top of blister 50, which then pushes product 54 through the backing sheet of blister pack 52 and also through blister aperture 314, thereby causing product 54 to exit package 370.

Figure 5:
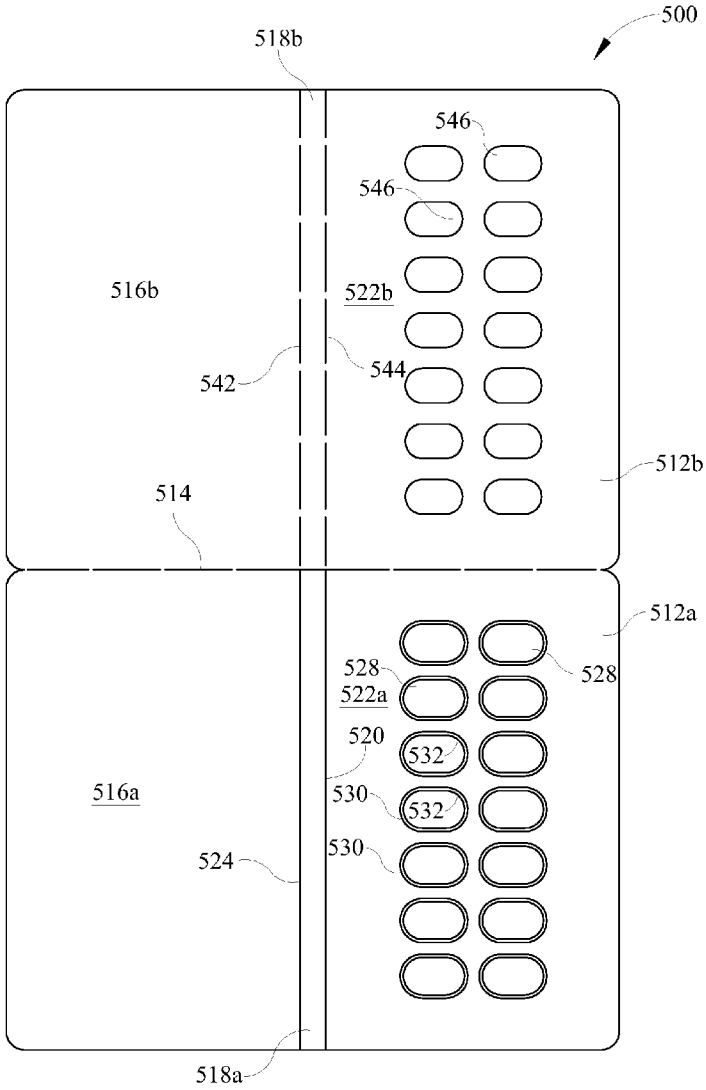
FIG. 5 is a plan view of an exemplary packaging blank, according to an embodiment of the present invention.

Referring now to the drawings, wherein like elements are represented by like numerals, FIG. 5 is a plan view of an exemplary packaging blank 500 made according to the present invention.

The packaging blank 500 includes a back panel 512*a* and a face panel 512*b*. The face panel 512*b* and the back panel 512*a* are hingedly connected along a foldable score line 514. Although in this exemplary embodiment, the panels 512*a* and 512*b* are illustrated as integrally formed as one piece, it should be understood that the respective panels 512*a* and 512*b* can be formed as two separate and distinct pieces.

The packaging blank 500 can be constructed from any suitable substrate material. Suitable substrate materials include, but are not limited to, plastics, conventional paperboard, including solid bleached sulfate (SBS) paperboard of suitable weight, size and shape, and combinations thereof. Commercial examples of suitable substrate include EASY SEAL® and EASY SEAL PLUS® self-sealing boards, both of which are currently available from MeadWestvaco Corporation. Additionally, it is contemplated that embodiments of the present invention may be used in conjunction with NATRALOCK® and ENDURANCE PTHS® packaging systems. Additionally, a tear-resistant layer may or may not be adhered to the packaging blank 500. Tear-resistant layers, if included, are often laminated to the packaging blank before cutting. Furthermore, it is possible that an abhesive layer or material may be added to the packaging blank 500 prior to assembling the packaging blank 500 into a package, as will be explained below. The abhesive layer serves to nullify adhesive properties that may be present on the surface of packaging blank 500. The packaging blank 500 may also be an unbleached board, depending on the desired appearance of the final package.

Figure 6:
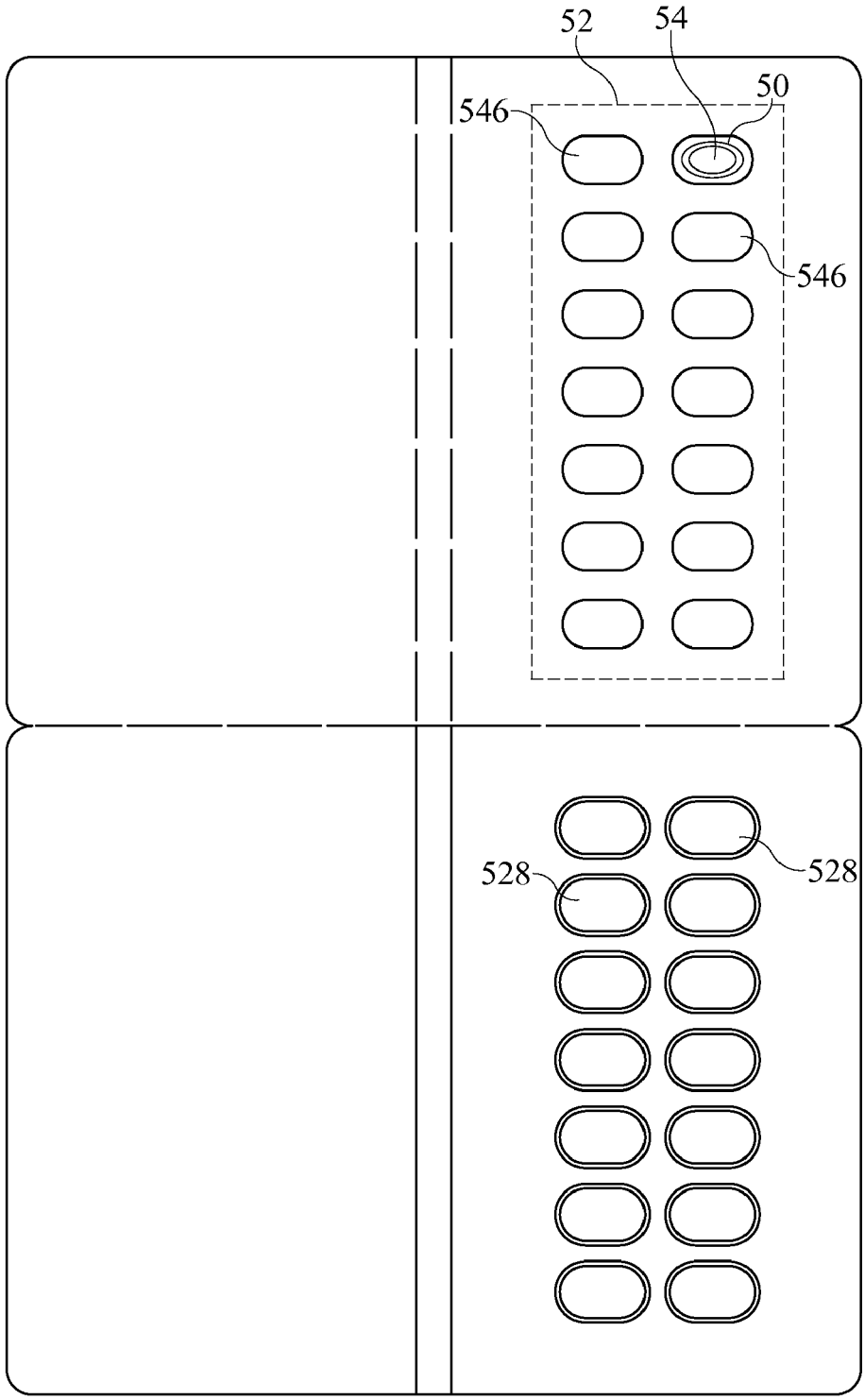
FIG. 6 is a plan view of an exemplary packaging blank including a blister pack, according to an embodiment of the present invention.

The face panel 512*b* further includes a top portion 516*b*. The top portion 516*b* is hingedly connected to a spacer portion 518*b* along a score line 542. The spacer portion 518*b* is hingedly connected to a bottom portion 522*b* along a score line 544. Bottom portion 522*b* further includes blister apertures 546. The blister apertures 546 are shaped and dimensioned to receive the blisters 50 of a blister pack 52, as shown in FIG. 6. As illustrated, one or more blisters 50 can contain a product 54, illustrated in FIG. 6 as a capsule of medication. The blister pack 52 has a backing sheet sufficiently thin to permit product 54 to be pushed through the backing with relatively low effort if no other layer (e.g., punch tab 528) is present.

Figure 7:
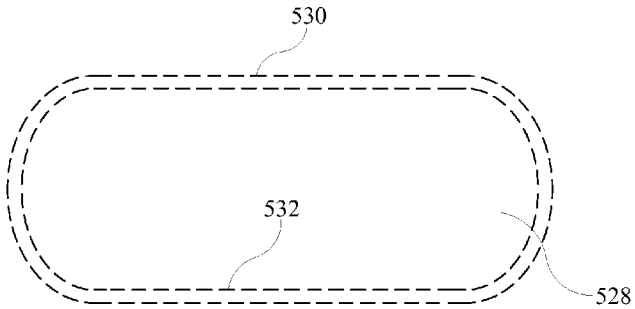
FIG. 7 is an enlarged plan view of a punch tab of the exemplary packaging blank of FIG. 5, defined by an inner perforation ring, with a corresponding outer perforation ring also shown.

Returning to FIG. 5, the back panel 512*a* further includes a top portion 516*a*. The top portion 516*a* is hingedly connected to a spacer portion 518*a* along a foldable score line 524. The spacer portion 518*a* is hingedly connected to a bottom portion 522*a* along a foldable score line 520. The bottom portion 522*a* further includes outer perforation rings 530, inner perforation rings 532, and punch tabs 528. The inner perforation rings 532 are positioned within outer perforation rings 530 in a concentric or substantially concentric alignment. The perforations of inner perforation rings 532 are staggered from those of outer perforation rings 530. One example of the staggered alignment of the perforations of the respective rings is shown in FIG. 7. Other staggered alignments using various combinations of perforation lengths and locations are also envisioned and within the scope of the present invention. A punch tab 528 can be defined as the material within inner perforation ring 532, as shown in FIGS. 6-7. The punch tabs 528 can have any desired shape and dimensions and are fully or partially removable from back panel 512*a*.

In other embodiments (not shown), the inner and outer perforations are arranged in lines that form shapes such as semicircles, triangles, or the like rather than rings. In other embodiments (not shown), an unperforated edge is present that connects the ends of the inner and outer perforation lines. In those embodiments, the punch tab may remain attached to back panel along the unperforated edge after the perforations are torn as described below.

Although FIGS. 5-6 are shown with two columns of blister apertures and punch tabs, other layouts are also contemplated. For example, the present invention includes a single column of blister apertures and punch tabs. In another embodiment, the packaging blank includes a single blister aperture and a single punch tab. These alternatives are presented not as a limitation but are exemplary of the many embodiments of the present invention.

Figure 8:
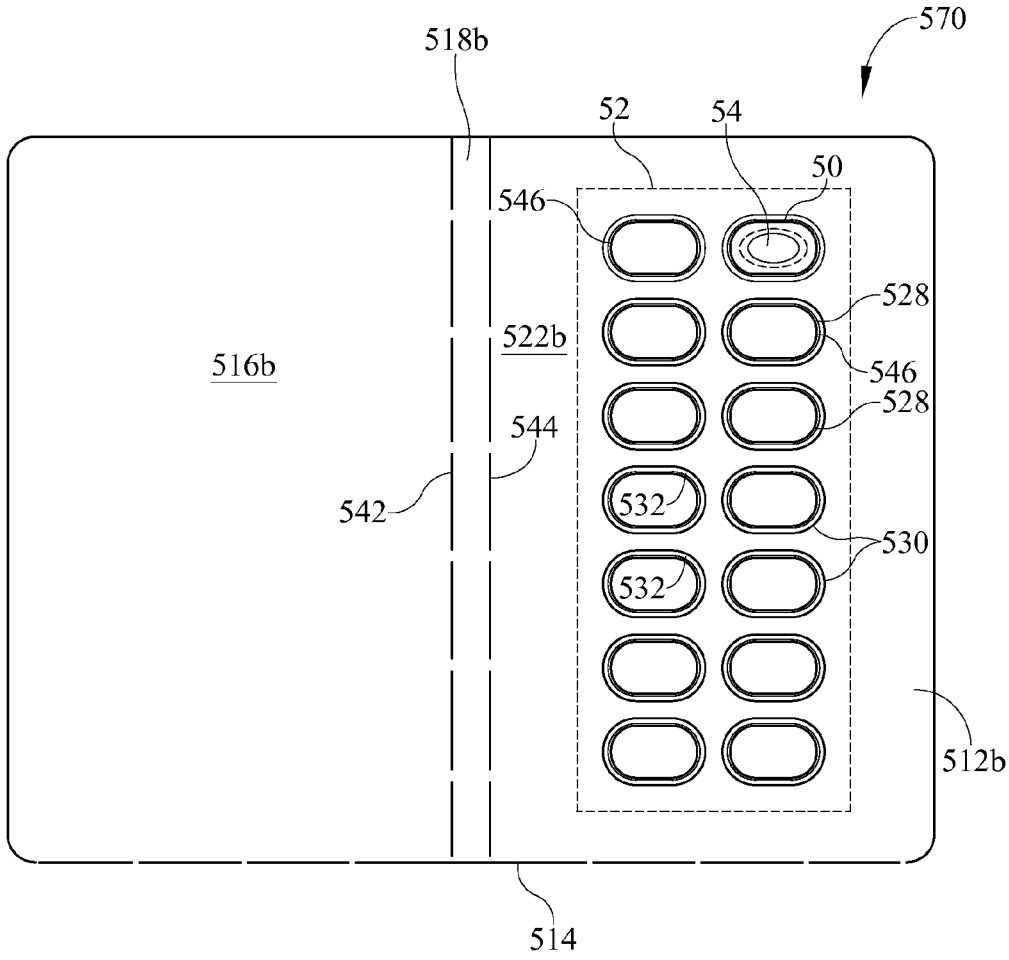
FIG. 8 is a plan view of an exemplary package, made from the packaging blank of FIG. 6.
Figure 9:
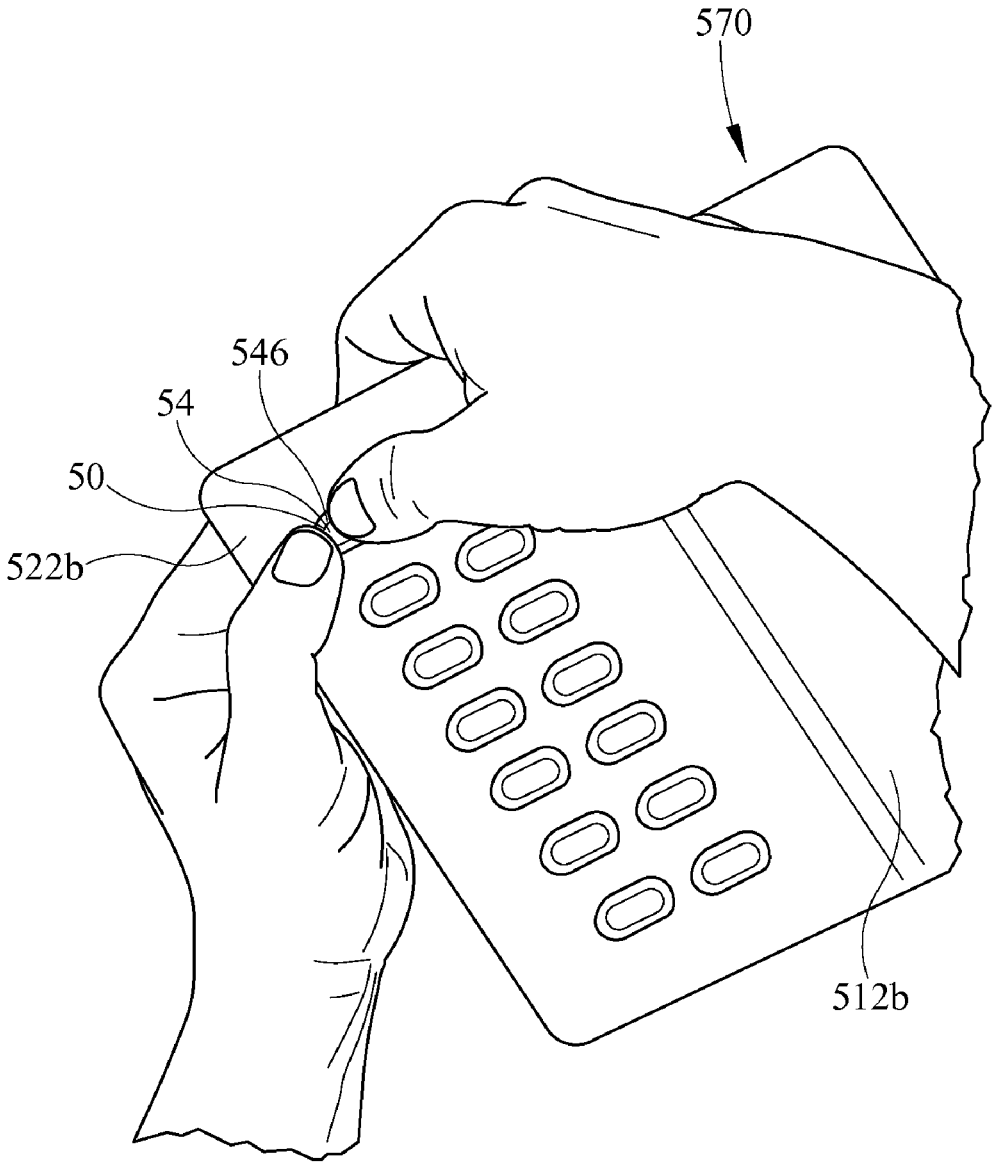
FIG. 9 illustrates a method for accessing products packaged in the exemplary package of FIG. 8.

With additional reference now to FIGS. 8-9, a package 570, made from packaging blank 500, is shown. A package 570 is formed by inserting the blisters 50 of a blister pack 52 into respective blister apertures 546, such that the blisters 50 protrude from the face panel 512*b*. After the blister pack 52 is in position, the packaging blank 500 can be folded into a face contacting arrangement, and secured. To fold the packaging blank 500, the facing surfaces of the back panel 512*a* and the face panel 512*b* (not visible in FIG. 8; see FIG. 6) are brought toward each other by folding along foldable score line 514. In completing the folding step, the punch tabs 528 are aligned with respective blister apertures 546, and thereby with blisters 50 of blister pack 52. Punch tabs 528 are of sufficient thickness to impart child-resistance qualities to package 570 by making it more difficult for product 54 to be removed from package 570 by merely applying pressure to blister 50. The face panel 512*b* and the back panel 512*a* can be secured to one another, and the blister pack 52 can thereby be held in place, using any desired means or methods, which are well known to those of ordinary skill in the package housing art.

As described below, punch tabs 528 are designed to be removed or partially removed from back panel 512*a* by being punched through by the consumer pressing the corresponding blister 50, thereby distinguishing the present invention from other approaches in which protective tabs are formed as tab strips and peeled. This permits the use of full-card heat sealing for the present invention, which is sometimes not available when manufacturing packages with peel-away tab strips, which often have zones that are more sensitive to heat. Thus, the streamlined design of the present invention helps reduce manufacturing costs.

In practice, to access an item 54 from a package 570, a greater amount of pressure is needed to be placed on blister 50 than would be needed in the absence of punch tab 528. This heightened pressure requirement can prevent a child from obtaining item 54. Moreover, the two rings of perforations provided by outer perforation rings 530 and inner perforation rings 532 make it more difficult for a child to pry away punch tabs 528 manually by directly pressing on them with his or her finger. At the same time, as shown in FIG. 9, an adult facing face panel 512*b* is capable of applying sufficient pressure to the top of blister 50 to push product 54 into punch tab 528 (not visible, located on the other side of package 570) with enough force to break some or all of the perforations of outer perforation rings 530 (not visible) and inner perforation rings 532 (not visible). This action by the adult moves product 54 through the backing sheet of blister pack 52 and tears all or a portion of punch tab 528 from back panel 512*a* (not visible), thereby causing product 54 to exit package 570 via blister aperture 546.

Figure 10:
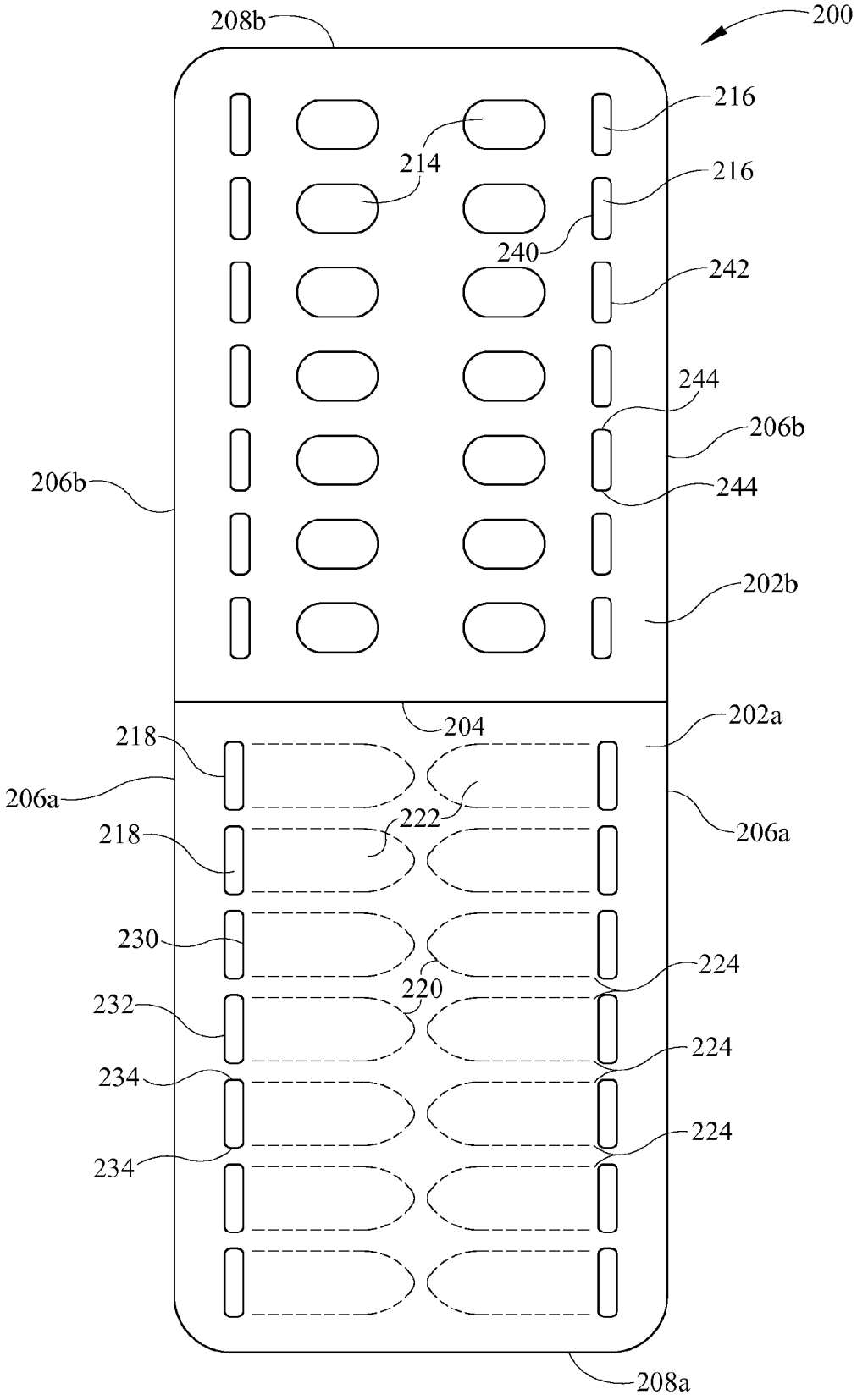
FIG. 10 is a plan view of an exemplary packaging blank, according to an embodiment of the present invention.

Referring now to the drawings, wherein like elements are represented by like numerals, FIG. 10 is a plan view of an exemplary packaging blank 200 made according to the present invention.

The packaging blank 200 includes a back panel 202*a* and a face panel 202*b*. The face panel 202*b* and the back panel 202*a* are hingedly connected along a foldable score line 204. The back panel 202*a* has two back panel side edges 206*a* and a back panel bottom edge 208*a*. The face panel 202*b* has two face panel side edges 206*b* and a face panel top edge 208*b*. Although in this exemplary embodiment, the panels 202*a* and 202*b* are illustrated as integrally formed as one piece, it should be understood that the respective panels 202*a* and 202*b* can be formed as two separate and distinct pieces.

The packaging blank 200 can be constructed from any suitable substrate material. Suitable substrate materials include, but are not limited to, plastics, conventional paperboard, including solid bleached sulfate (SBS) paperboard of suitable weight, size and shape, and combinations thereof. Commercial examples of suitable substrate include EASY SEAL® and EASY SEAL PLUS® self-sealing boards, both of which are currently available from MeadWestvaco Corporation. Additionally, it is contemplated that embodiments of the present invention may be used in conjunction with NATRALOCK® and ENDURANCE PTHS® packaging systems. Additionally, a tear-resistant layer may or may not be adhered to the packaging blank 200. Tear-resistant layers, if included, are often laminated to the blank before cutting. Furthermore, it is possible that an abhesive layer or material may be added to the packaging blank 200 prior to assembling the packaging blank 200 into a package, as will be explained below. The abhesive layer serves to nullify adhesive properties that may be present on the surface of packaging blank 200. The packaging blank 200 may also be an unbleached board, depending on the desired appearance of the final package.

The back panel 202*a* further includes severance lines 220 and tab strips 222. The severance lines 220, which define tab strips 222, can be shaped and dimensioned to allow removal of material by interfacing with a tool in a method that will be described in more detail below. The back panel 202*a* further includes back panel slots 218. The back panel slot 218 includes a back panel slot inner edge 230 positioned towards tab strip 222 and a back panel slot outer edge 232 positioned towards back panel side edge 206*a* in the other direction. The back panel slot 218 also includes a pair of connecting edges 234, with these edges connecting the ends of back panel slot inner edge 230 and back panel slot outer edge 232. Different types of apertures other than slots may also be used in place of back panel slot 218. Alternatively, a severance line may be used to define material within back panel 202*a* that will later be removed to form the back panel slot 218 or other type of aperture. The tab strips 222 can have any desired shape and dimensions. For example, the back panel 202*a* can be configured to include gates (not shown) that can be left after a tab strip 222 is removed.

Figure 11:
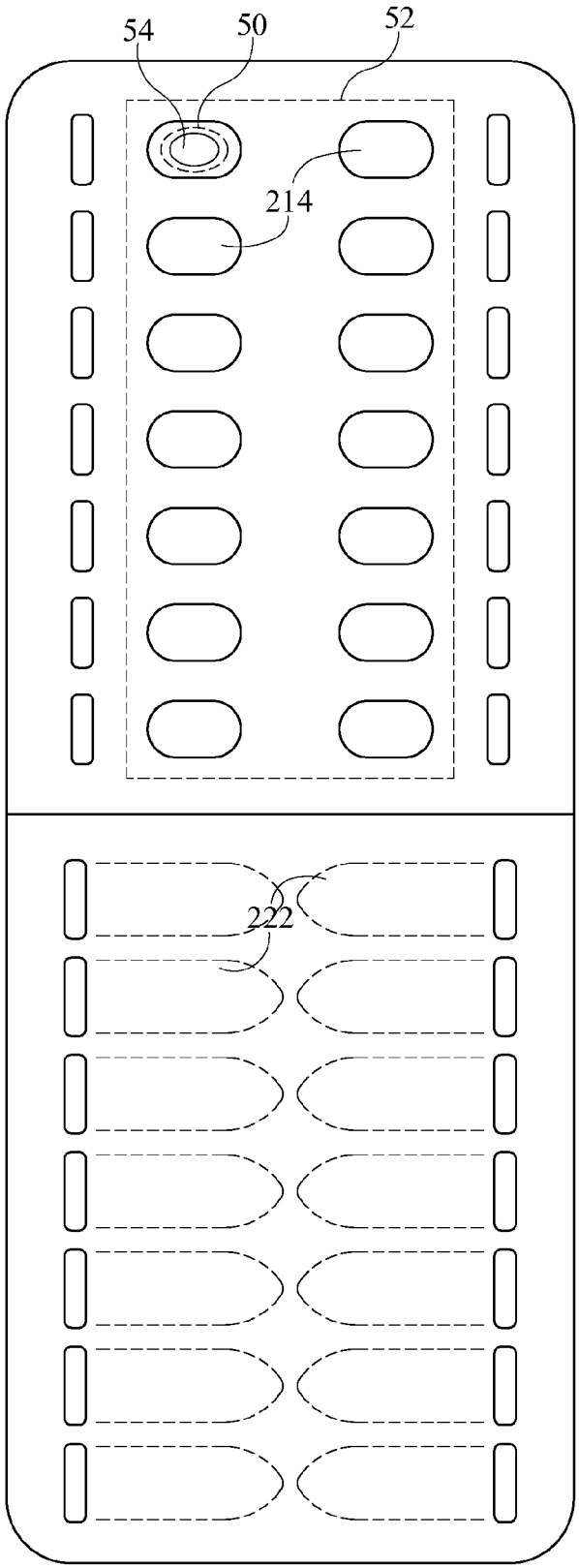
FIG. 11 is a plan view of an exemplary packaging blank including a blister pack, according to an embodiment of the present invention.

The face panel 202*b* further includes blister apertures 214 and face panel slots 216. The face panel slot 216 includes a face panel slot inner edge 240 positioned towards blister aperture 214 and a face panel slot outer edge 242 positioned towards face panel side edge 206*b* in the other direction. The face panel slot 216 also includes a pair of connecting edges 244, with these edges connecting the ends of face panel slot inner edge 240 and face panel slot outer edge 242. Different types of apertures other than slots may also be used in place of face panel slot 216. Alternatively, a severance line may be used to define material within face panel 202*b* that will later be removed to form the face panel slot 216 or other type of aperture. The blister apertures 214 are shaped and dimensioned to receive the blisters 50 of a blister pack 52, as shown in FIG. 11. As illustrated, one or more blisters 50 can contain a product 54, illustrated in FIG. 11 as a capsule of medication. The blister pack 52 has a backing sheet sufficiently thin to permit product 54 to be pushed through the backing with relatively low effort if no other layer (e.g., tab strip 222) is present.

Although FIGS. 10-11 are shown with two columns of blister apertures and tab strips, other layouts are also contemplated. For example, the present invention includes a single column of blister apertures and tab strips. Alternatively, in the two-column layout, the face panel slots may be placed in between the two columns of blister apertures and the back panel slots may be placed in between the two columns of tab strips. In another embodiment, the packaging blank includes a single blister aperture, tab strip, face panel slot, and back panel slot. These alternatives are presented not as a limitation but are exemplary of the many embodiments of the present invention.

Figure 12:
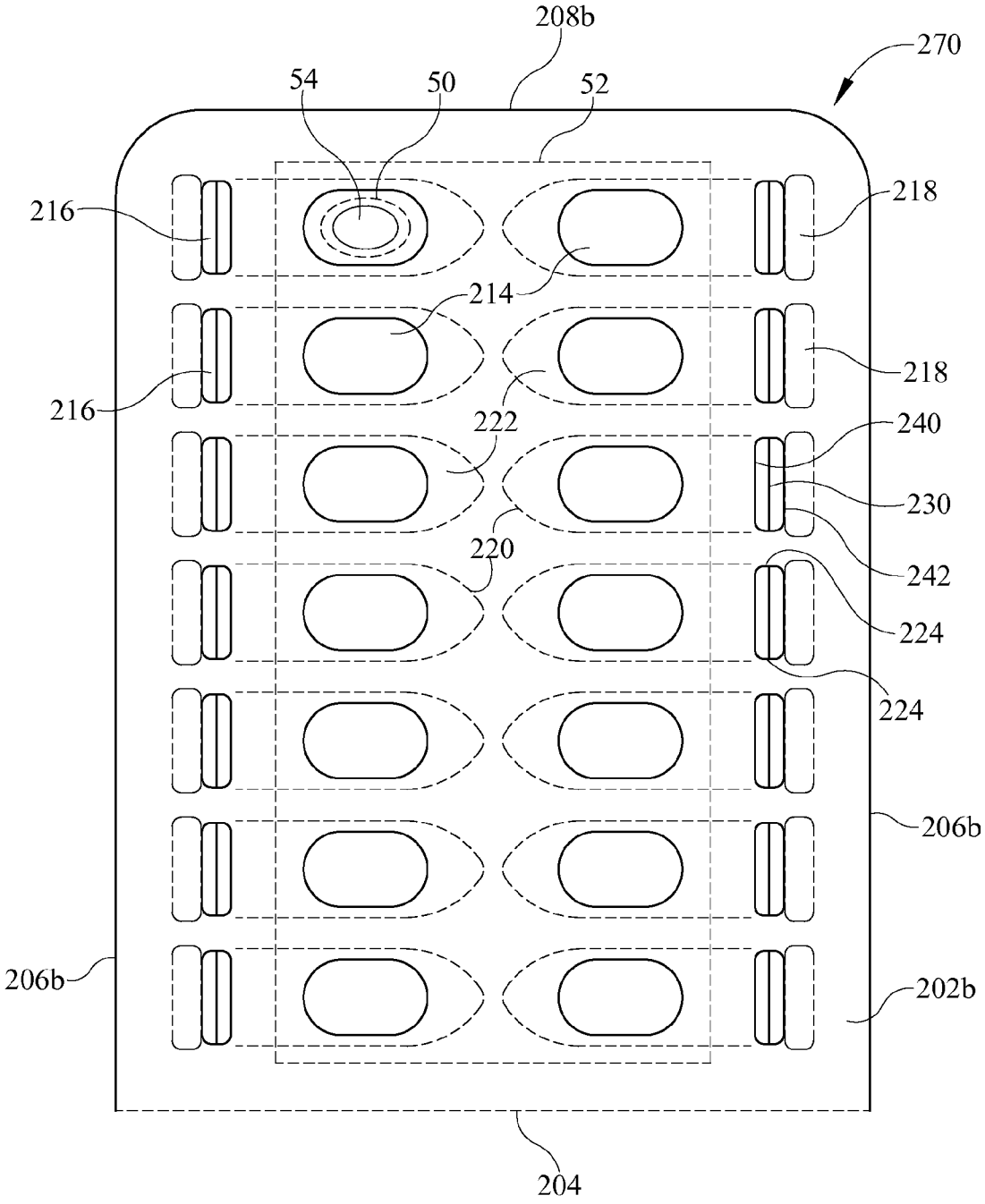
FIG. 12 is a plan view of an exemplary package, made from the packaging blank of FIG. 11.
Figure 13:
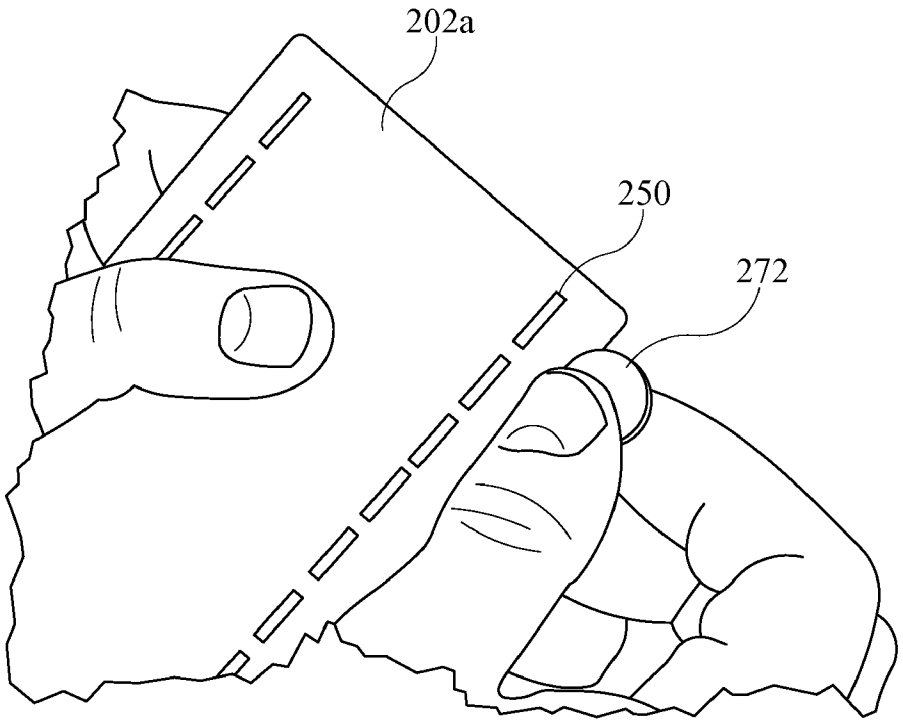
FIG. 13 illustrates a method for accessing products packaged in the exemplary package of FIG. 12.

With additional reference now to FIGS. 12-13, a package 270, made from packaging blank 200, is shown. A package 270 is formed by inserting the blisters 50 of a blister pack 52 into respective blister apertures 214, such that the blisters 50 protrude from the face panel 202*b*. After the blister pack 52 is in position, the packaging blank 200 can be folded into a face contacting arrangement, and secured. To fold the packaging blank 200, the facing surfaces of the back panel 202*a* and the face panel 202*b* are brought toward each other by folding along foldable score line 204. In completing the folding step, the tab strips 222 are aligned with respective blister apertures 214, and thereby with blisters 50 of blister pack 52. Tab strips 222 are of sufficient thickness to impart child-resistance qualities to package 270 by making it difficult for product 54 to be removed from package 270 by merely applying pressure to blister 50. After the packaging blank 200 is folded, the back panel slots 218 and face panel slots 216 are vertically aligned but offset horizontally, such that the back panel slot inner edges 230 are aligned between face panel slot inner edges 240 and face panel slot outer edges 242, thereby making back panel slot inner edge 230 visible to a person viewing face panel 202*b*. The face panel 202*b* and the back panel 202*a* can be secured to one another, and the blister pack 52 can thereby be held in place, using any desired means or methods, which are well known to those of ordinary skill in the package housing art.

In practice, to access an item 54 from a package 270, with back panel 202*a* facing the user, a tool 272, illustrated in FIG. 13 as a penny, is inserted through package slot 250, which is the opening through package 270 in between back panel slot inner edge 230 and face panel slot outer edge 242. Other commonly available items, including but not limited to other types of coins, keys, flathead screwdrivers, knives, letter openers, and the like, may also function as tool 272. Once inserted, tool 272 is twisted back and forth in a manner that generates pressure on tearing zones 224, located between back panel slot 218 and the ends of severance line 220. The twisting is best done using a motion similar to that used to unlock a standard house or car door lock with a key. During such a motion, one part of tool 272 is pressed against face panel outer edge 242 while another part is pressed against tearing zone 224. This arrangement permits the user to use the material at face panel outer edge 242 as leverage for pressing against tearing zone 224. Most adults will find such a motion to be very easy and natural. The twisting motion eventually tears the material of tearing zones 224 and possibly a portion of severance line 220. Once tearing zones 224 have been torn, the user will be able to grasp tab strip 222 and peel it up from back panel 202*a* and away from back panel slot 218. As tab strip 222 is peeled, it separates from back panel 202*a* along severance line 220. The severance line 220 permits the user to tear most or all of tab strip 222 from package 270, such that there is adequate access to allow product 54 to pass out of package 270. The user can then apply force to the top of blister 50, which then pushes product 54 through the backing sheet of blister pack 52 and also through blister aperture 214, thereby causing product 54 to exit package 270.

Figure 14:
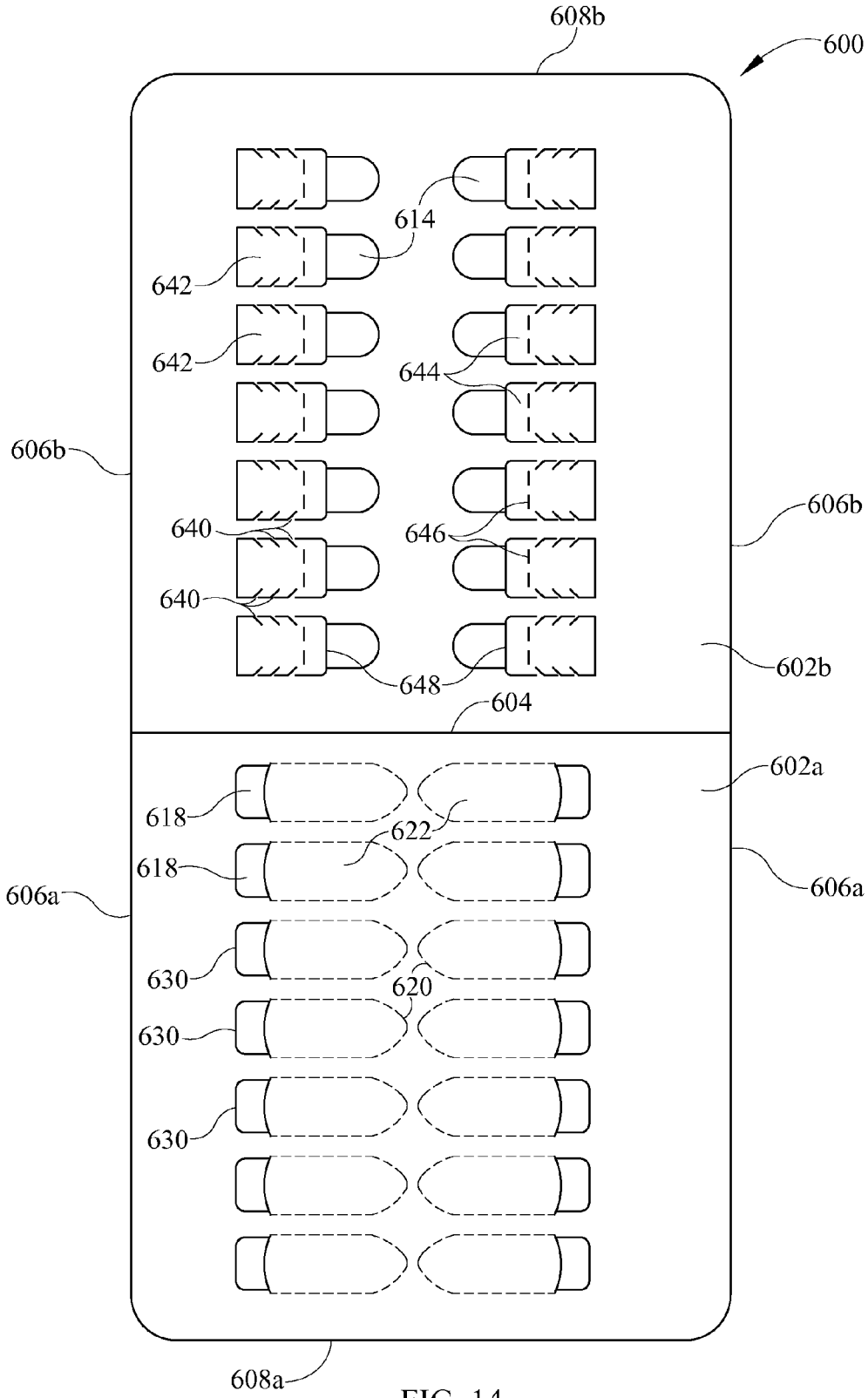
FIG. 14 is a plan view of an exemplary packaging blank, according to an embodiment of the present invention.

Referring now to the drawings, wherein like elements are represented by like numerals, FIG. 14 is a plan view of an exemplary packaging blank 600 made according to the present invention.

The packaging blank 600 includes a back panel 602*a* and a face panel 602*b*. The face panel 602*b* and the back panel 602*a* are hingedly connected along a foldable score line 604. The back panel 602*a* has two back panel side edges 606*a* and a back panel bottom edge 608*a*. The face panel 602*b* has two face panel side edges 606*b* and a face panel top edge 608*b*. Although in this exemplary embodiment, the panels 602*a* and 602*b* are illustrated as integrally formed as one piece, it should be understood that the respective panels 602*a* and 602*b* can be formed as two separate and distinct pieces.

The packaging blank 600 can be constructed from any suitable substrate material. Suitable substrate materials include, but are not limited to, plastics, conventional paperboard, including solid bleached sulfate (SBS) paperboard of suitable weight, size and shape, and combinations thereof. Commercial examples of suitable substrate include EASY SEAL® and EASY SEAL PLUS® self-sealing boards, both of which are currently available from MeadWestvaco Corporation. Additionally, it is contemplated that embodiments of the present invention may be used in conjunction with NATRALOCK® and ENDURANCE PTHS® packaging systems. Additionally, a tear-resistant layer may or may not be adhered to the packaging blank 600. Tear-resistant layers, if included, are often laminated to the blank before cutting. Furthermore, it is possible that an abhesive layer or material may be added to the packaging blank 600 prior to assembling the packaging blank 600 into a package, as will be explained below. The abhesive layer serves to nullify adhesive properties that may be present on the surface of packaging blank 600. Any such abhesive layer is designed not to interfere with the desired adhesion between certain portions of face panel 602*b* and back panel 602*a* discussed below. The packaging blank 600 may also be an unbleached board, depending on the desired appearance of the final package.

The back panel 602*a* further includes back panel tab strip severance lines 620 (shown as dashed lines) and back panel tab strips 622. The back panel tab strip severance lines 620, which define back panel tab strips 622, can be shaped and dimensioned to allow removal of material in a method that will be described in more detail below. The back panel 602*a* further includes cut-away areas 618, which are defined by cut-away area severance lines 630 (shown as solid lines). The back panel tab strip severance lines 620 and the cut-away area severance lines 630 may be adjacent to each other as shown in FIG. 14. Alternatively, small spaces may be present between back panel tab strip severance lines 620 and cut-away area severance lines 630. The back panel tab strips 622 can have any desired shape and dimensions. For example, the back panel 602*a* can be configured to include gates (not shown) that can be left after a back panel tab strip 622 is removed.

Figure 15:
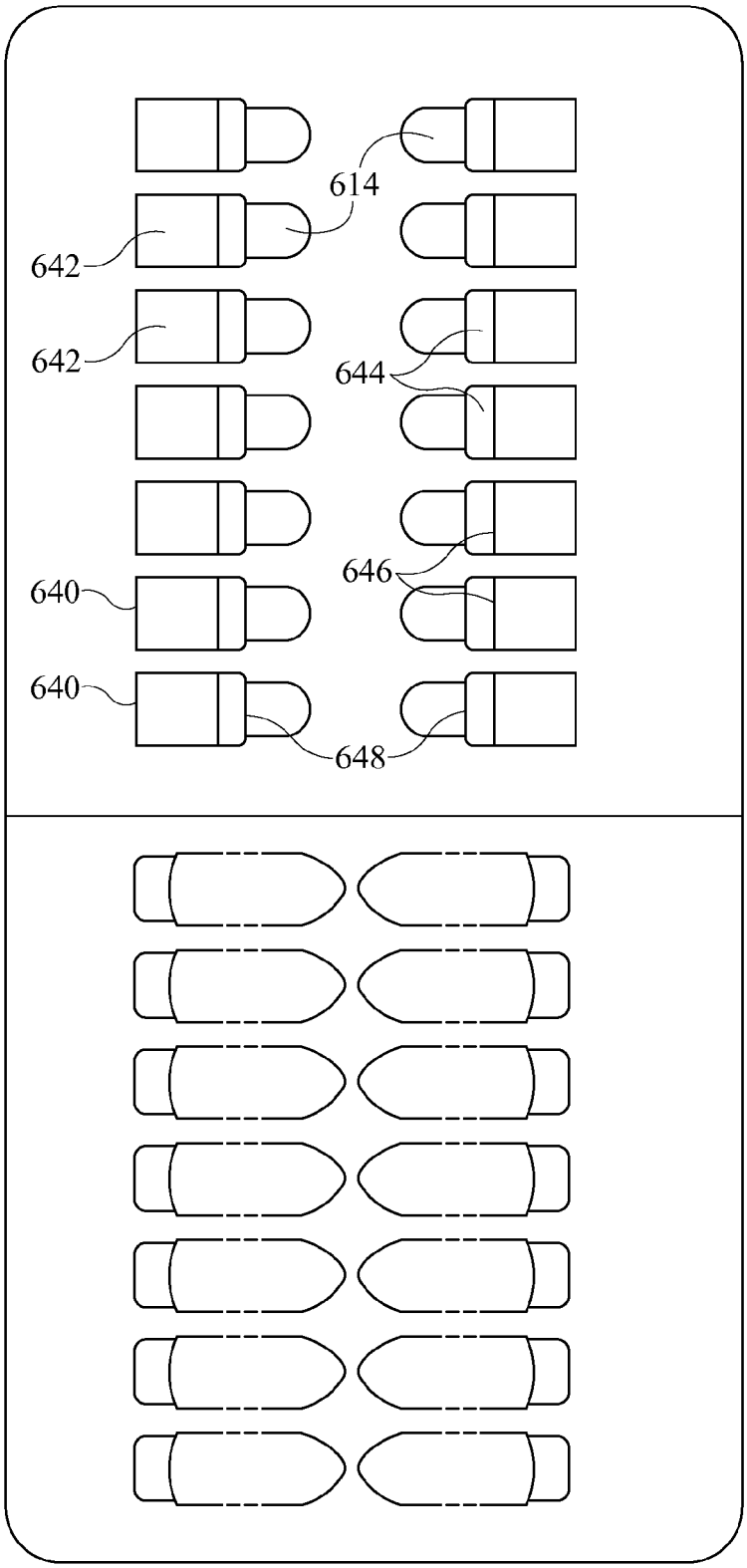
FIG. 15 is a plan view of another exemplary packaging blank, according to another embodiment of the present invention.

The face panel 602*b* further includes blister apertures 614, face panel tab strip severance lines 640, and face panel tab strips 642, as shown in FIG. 14. The face panel tab strips 642 include tab strip grasping zones 644 positioned towards blister apertures 614, with grasping zone edges 648 adjacent to blister apertures 614. The tab strip grasping zones 644 are separated from the rest of face panel tab strips 642 by grasping zone severance lines 646. The face panel tab strip severance lines 640 and grasping zone edges 648 define the face panel tab strips 642. Another embodiment of the invention having an alternative design for the face panel tab strip severance lines 640 and the face panel tab strips 642 is shown in FIG. 15. In this embodiment, face panel tab strip severance lines 640 are single lines, in contrast to the design shown in FIG. 14, which includes multiple lines, some of which are angled and positioned diagonally inside the material of face panel tab strip 642. Other embodiments for face panel tab strip severance lines 640, including the options for severance lines set forth above, are also contemplated.

Figure 16:
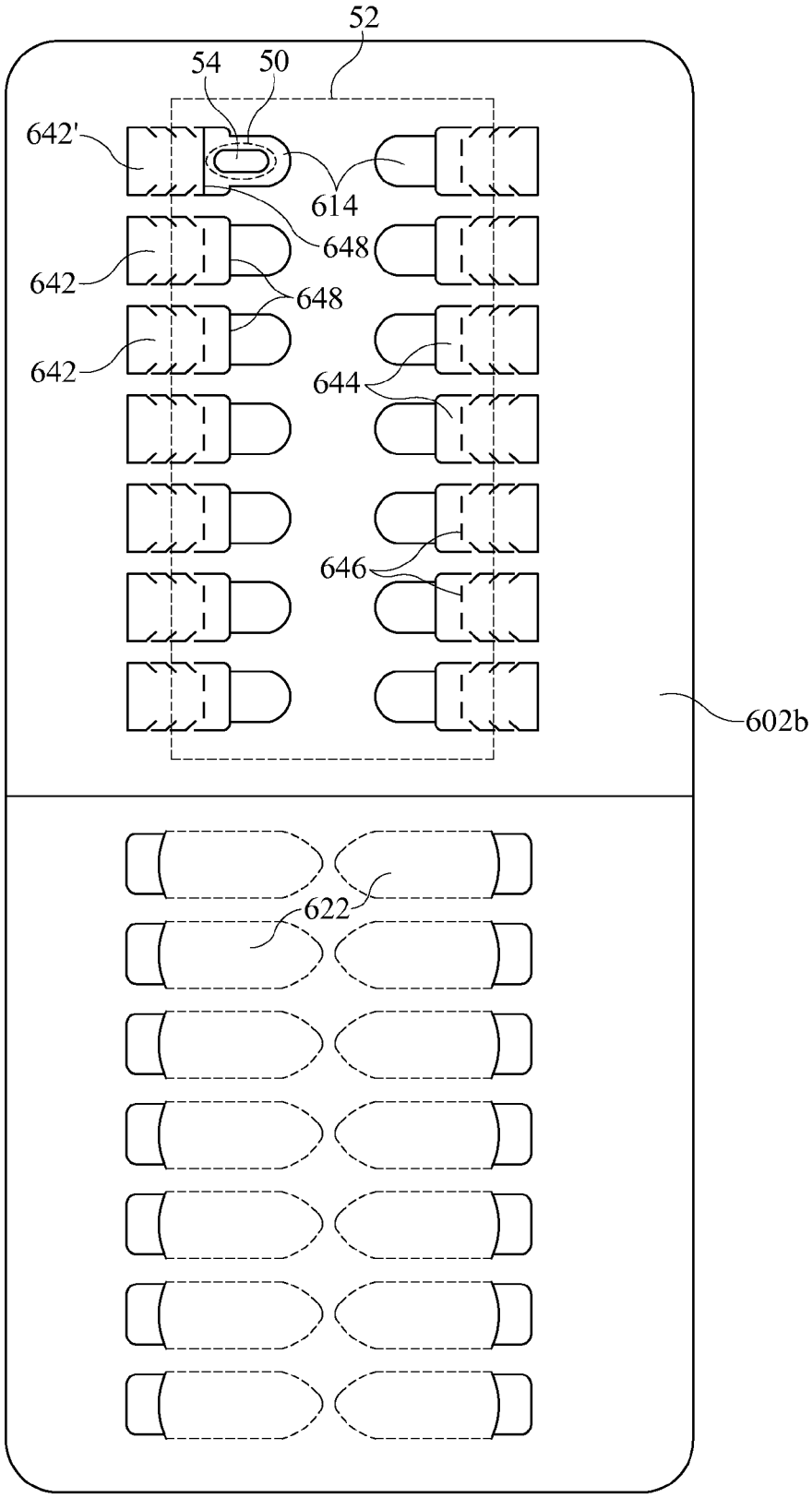
FIG. 16 is a plan view of an exemplary packaging blank including a blister pack, according to an embodiment of the present invention.

The blister apertures 614 are shaped and dimensioned to receive the blisters 50 of a blister pack 52, as shown in FIG. 16. As illustrated, one or more blisters 50 can contain a product 54, illustrated in FIG. 16 as a capsule of medication. As illustrated in FIG. 16, if blister 50 is larger than blister aperture 614, blister 50 may cause tab strip grasping zone 644 to fold upward along grasping zone severance line 646, resulting in the formation of folded face panel tab strip 642'. In the folded arrangement, grasping zone edge 648 can face perpendicularly outward from face panel 602*b* as shown in FIG. 16. In FIG. 16, blister 50 is shown as present only in the blister aperture 614 located in the upper-left-hand corner, in order to demonstrate the contrast between folded face panel tab strip 642' and face panel tab strips 642 that have not yet been folded by the insertion of blisters 50 through blister apertures 614. In other embodiments of the invention where blister apertures 614 are large enough to accommodate the entire blister 50, face panel tab strips 642 remain unfolded until a user folds them prior to removing them as described below.

Figure 17A:
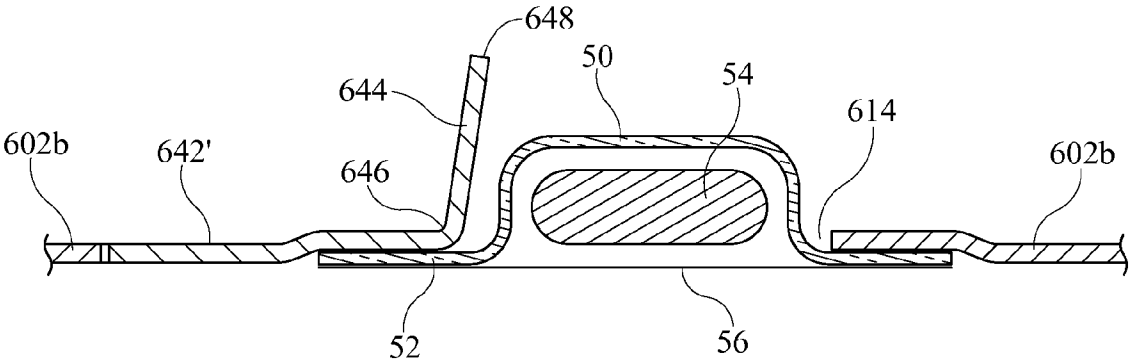
FIGS. 17*a* and 17*b* are a side view and a top view, respectively, of an exemplary packaging blank according to an embodiment of the present invention with a blister pack inserted therein.
Figure 17B:
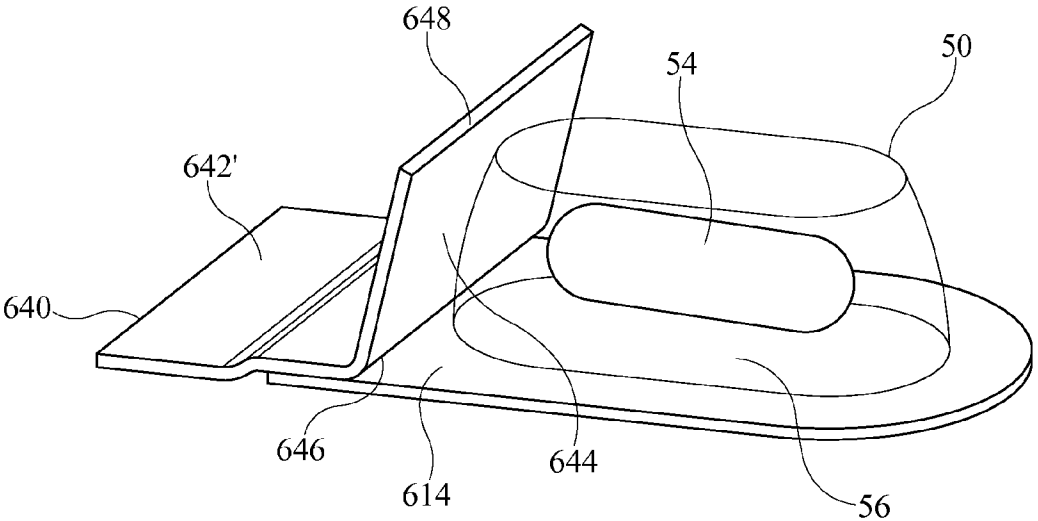

A side view of a similar arrangement is shown in FIG. 17*a*, with tab strip grasping zone 644 folded at a slightly smaller angle with respect to face panel 602*b*, in contrast with the perpendicular configuration depicted in FIG. 16. Other angles may also be employed according to the invention. FIG. 17*a* also illustrates blister pack 52 having a thin backing sheet 56. Backing sheet 56 is sufficiently thin to permit product 54 to be pushed through the backing with relatively low effort if no other layer (e.g., back panel tab strip 622 of FIG. 14) is present. FIG. 17*b* shows a three-dimensional view of an embodiment similar to that shown, in FIG. 17*a*. FIG. 17*b* shows a single-line design for face panel tab strip severance line 640 similar to the one shown in FIG. 15.

Figure 18C:
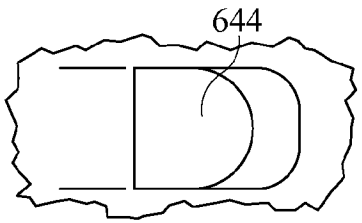
FIGS. 18*b*, 18*c*, 18*d* and 18*e* are top views of various face panel tab strips according to embodiments of the present invention.
Figure 18D:
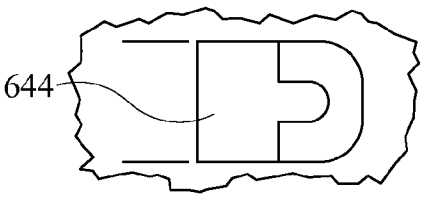
Figure 18E:
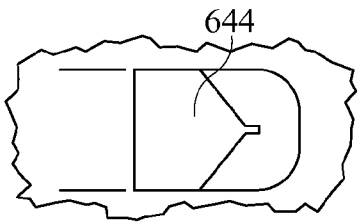
Figure 18A:
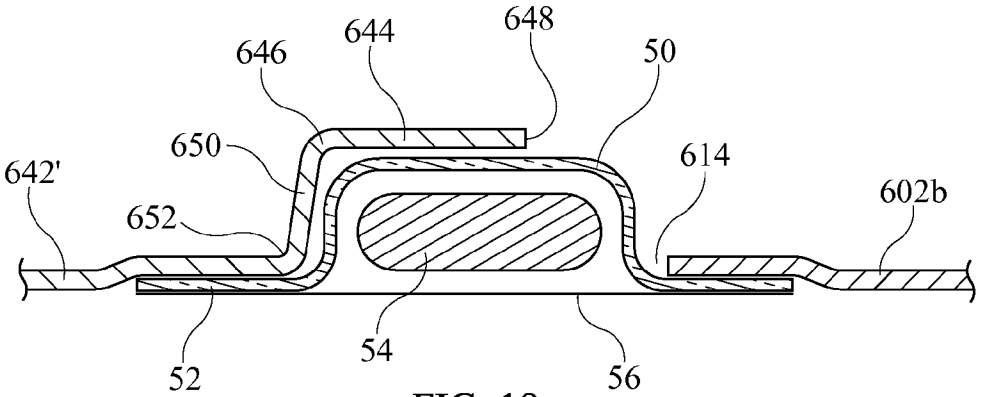
FIG. 18*a* shows a side view of another exemplary packaging blank according to an embodiment of the present invention.
Figure 18B:
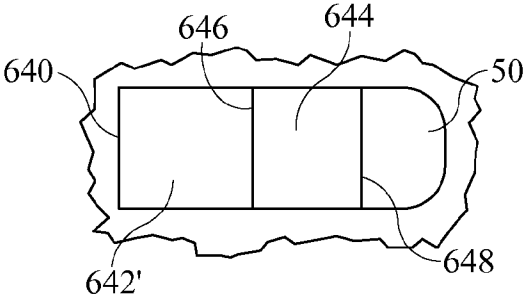

FIGS. 18*a*, 18*b*, 18*c*, 18*d* and 18*e* shows additional embodiments of folded face panel tab strip 642'. In FIG. 18*a*, folded face panel tab strip 642' includes a spacing zone 650 and spacing zone severance line 652 inserted between tab strip grasping zone 644 and the rest of folded face panel tab strip 642'. With spacing zone 650 in place, tab strip grasping zone 644 can partially or completely cover blister 50. FIG. 18*b* shows a similar embodiment, but with spacing zone 650 (not visible in FIG. 18*b*) in a more perpendicular alignment with the rest of folded face panel tab strip 642'. The tab strip grasping zone 644, shown as rectangular in FIG. 18*b*, can be formed into any desired shape, including the rounded, tabbed, and pointed exemplary embodiments shown in FIGS. 18*c*, 18*d*, and 18*e*, respectively.

Although FIGS. 14-16 are shown with two columns of blister apertures and tab strips, other layouts are also contemplated. For example, the present invention includes a single column of blister apertures, face panel tab strips, back panel tab strips, and cut-away areas. Alternatively, in the two-column layout, the cut-away areas may be placed in between the two columns of back panel tab strips and the orientations of the two sets of tab strips (face panel and back panel) may be horizontally reversed. In another embodiment, the packaging blank includes a single blister aperture, face panel tab strip, back panel tab strip, and cut-away area. These alternatives are presented not as a limitation but are exemplary of the many embodiments of the present invention.

Figure 19:
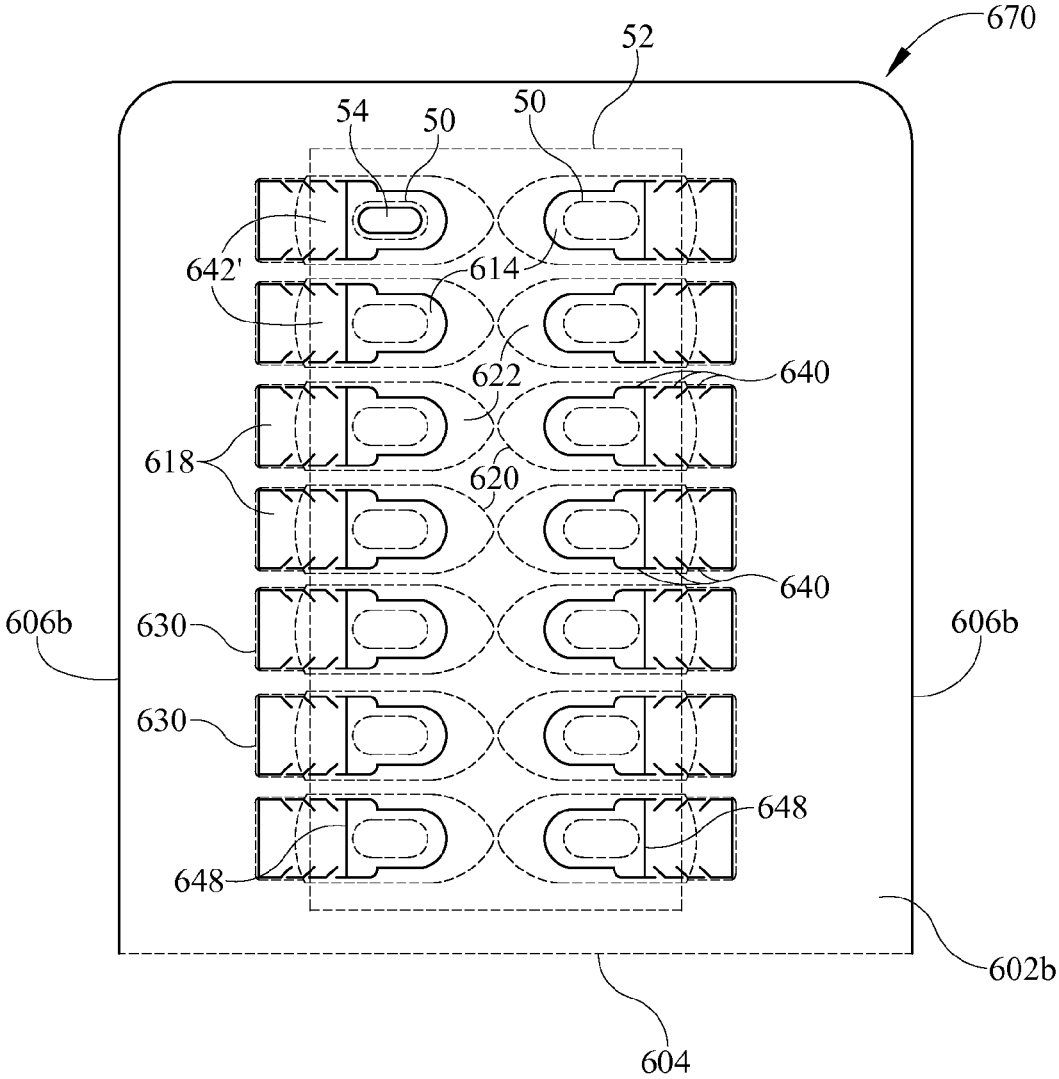
FIG. 19 is a plan view of an exemplary package, made from the packaging blank of FIG. 14 and housing a blister pack.
Figure 20:
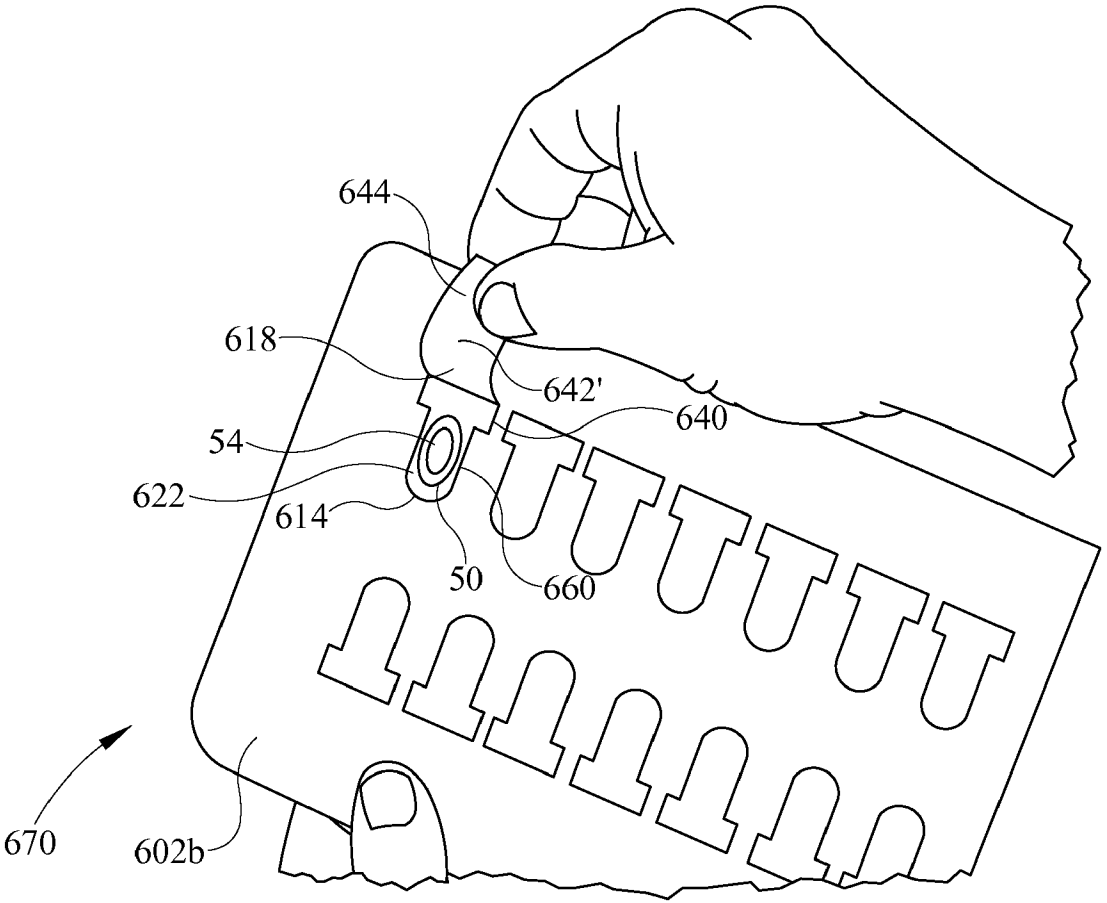
FIG. 20 illustrates a method for accessing products packaged in the exemplary package of FIG. 19.

With additional reference now to FIGS. 19-21, a package 670, made from packaging blank 600, is shown. A package 670 shown in FIG. 6 is formed by inserting the blisters 50 of a blister pack 52 into respective blister apertures 614 of packaging blank 600, such that the blisters 50 protrude from the face panel 602*b*. The blisters 50 also fold face panel tab strips 642 (as shown in FIG. 14) along grasping zone severance lines 646 (not visible in FIG. 19; shown in FIG. 14) to form folded face panel tab strips 642'. In this design, tab strip grasping zones 644 are protruding perpendicularly upward from face panel 602*b*, with grasping zone edges 648 visible to a person facing face panel 602*b*. The remainders of folded face panel tab strips 642' stay in the same plane as the rest of face panel 602*b*.

After the blister pack 52 is in position, the packaging blank 600 can be folded into a face contacting arrangement, and secured. To fold the packaging blank 600, the facing surfaces of the back panel 602*a* and the face panel 602*b* are brought toward each other by folding along foldable score line 604. In completing the folding step, the back panel tab strips 622 are aligned with respective blister apertures 614, and thereby with blisters 50 of blister pack 52. Also, the cut-away areas 618 (defined by cut-away area severance lines 630, now shown in dashed lines because they are behind face panel 602*b*) are aligned with and adhered to the portions of folded face tab strips 642' that are still in the same plane as face panel 602*b*. Back panel tab strips 622 are of sufficient thickness to impart child-resistance qualities to package 670 by making it difficult for product 54 to be removed from package 670 by merely applying pressure to blister 50. After the packaging blank 600 is folded, the face panel 602*b* and the back panel 602*a* can be secured to one another, and the blister pack 52 can thereby be held in place, using any desired means or methods, which are well known to those of ordinary skill in the package housing art.

The invention permits the above-described assembly to be performed relatively easily. In many cases the material that normally needs to be removed from the face panel to form the blister apertures can be retained and used as the face panel tab strips. Removing material to form small apertures can be especially difficult, and the present invention avoids that problem while creating a functional, user-friendly face panel tab strip that helps impart child-resistance qualities to the package as described below.

In practice, to access an item 54 from a package 670, with face panel 602*b* facing the user, the user grasps tab strip grasping zone 644 and pulls it upward from face panel 602*b* and away from corresponding blister aperture 614, as shown in FIG. 20. (In embodiments of the invention where blister apertures 614 are large enough to accommodate the entire blister 50, the user can lift up tab strip grasping zone 644 with a fingernail in order to fold it upwards and grasp it.) This action by the user tears folded face panel tab strip 642' along face panel tab strip severance lines 640, thereby completely or partially removing folded face panel tab strip 642' out of face panel 602*b*. Because folded face panel tab strip 642' is adhered to cut-away area 618, the same action pulls cut-away area 618 out of back panel 602*a*. With folded face panel tab strip 642' and cut-away area 618 removed from face panel 602*b* and back panel 602*a*, respectively, package aperture 660 is created.

The presence of package aperture 660 enables the user to grasp back panel tab strip 622 after turning package 670 over so that back panel 602*a* faces the user. The user next peels back panel tab strip 622 up from back panel 602*a* and away from package aperture 660. As back panel tab strip 622 is peeled, it separates from back panel 602*a* along back panel tab strip severance line 620. The back panel tab strip severance line 620 permits the user to tear most or all of back panel tab strip 622 from package 670, such that there is adequate access to allow product 54 to pass out of package 670. The user then turns package 670 back over so face panel 602*b* is again facing the user. The user can then apply force to the top of blister 50, which pushes product 54 through the backing sheet 56 of blister pack 52 and also through blister aperture 614, thereby causing product 54 to exit package 670.

Figure 21A:
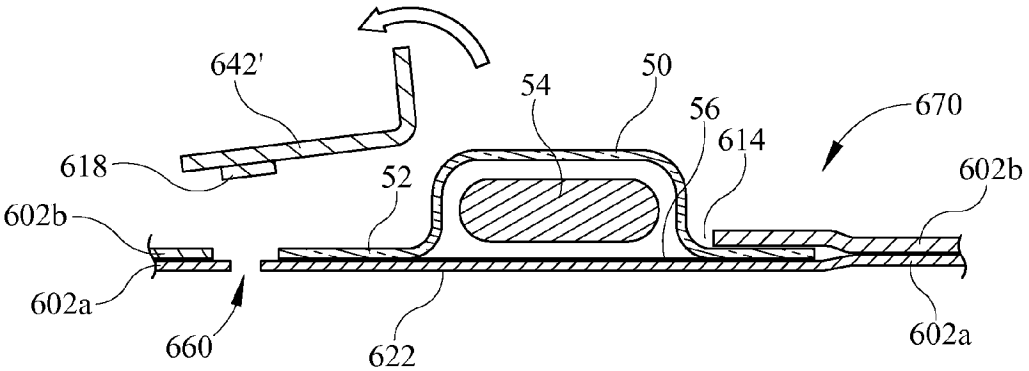
FIGS. 21*a*, 21*b* and 21*c* are side views which depict from another angle the motions associated with the method illustrated in FIG. 20.
Figure 21B:
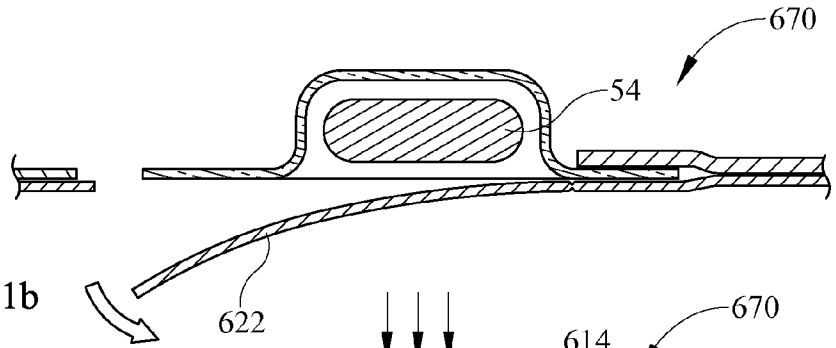
Figure 21C:
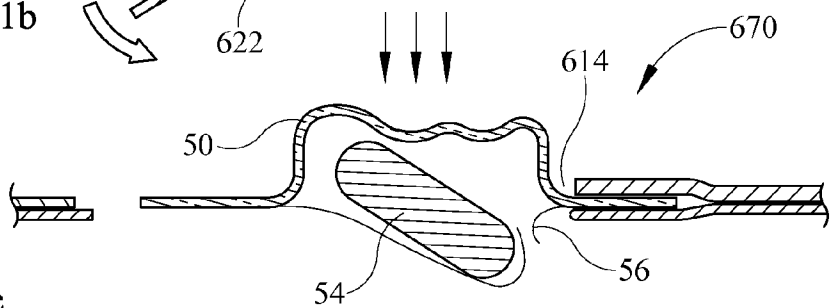

Side views of this method of accessing product 54 are shown in FIGS. 21*a*, 21*b* and 21*c*. FIG. 21*a* depicts folded face panel tab strip 642' being pulled in the direction of the arrow, which removes face panel tab strip 642' from package 670, in this instance completely. Cut-away area 618, as discussed above, is also removed because it is adhered to face panel tab strip 642'. In the next step, shown in FIG. 21*b*, back panel tab strip 622 is pulled in the direction of the arrow and away from its position covering product 54. Finally, as shown in FIG. 21*c*, pressure (shown by a double arrow) is applied onto blister 50, which pushes product 54 through backing sheet 56 (rupturing it in the process as shown) and out of package 670 (through blister aperture 614).

The above-described embodiments are merely exemplary illustrations of implementations set forth for a clear understanding of the principles of the invention. Variations, modifications, and combinations may be made to the above-described embodiments without departing from the scope of the claims. All such variations, modifications, and combinations are included herein by the scope of this disclosure and the following claims.

What is claimed is:

1. A packaging blank comprising:
a first panel including a blister aperture; and
a second panel having a facing surface and including an inner ring and an outer ring, the inner ring being positioned with the outer ring in a substantially concentric arrangement, the inner and outer rings both being formed at least in the facing surface of the second panel such that the inner and outer rings are visible at least from the facing surface of the second panel, wherein:
said inner ring is comprised of a series of perforations and said outer ring is comprised of a series of perforations in which the perforations of said inner ring are staggered from the perforations of said outer ring such that each of at least some of the perforations of said inner ring is radially aligned with a space between two adjacent perforations of the outer ring as viewed at least from the facing surface of the second panel; and
the blister aperture and the inner ring are aligned when the facing surface of the second panel is secured to the first panel.

2. The packaging blank of claim 1, wherein said first panel and said second panel are connected by a foldable score line.

3. A blister package housing comprising:
a packaging blank as claimed in claim 1;
a blister pack comprising a blister; and
securing means, wherein:
said blister is aligned with the blister aperture of said first panel;
said first panel and said second panel are secured to one another by said securing means; and
said blister pack is secured in between the first panel and the second panel.

4. The blister card package housing of claim 3, wherein the first and second panels are secured together by full-card heat sealing.

5. The blister card package housing of claim 4, wherein the inner ring defines a punch tab that is at least partially removable from the second panel, and the punch tab is secured to the blister pack.

6. A packaging blank comprising:

a first panel including a blister aperture; and a second panel having a facing surface and including an inner ring and an outer ring, the inner ring being positioned within the outer ring in a substantially concentric arrangement such that a ring-shaped strip is defined between the inner and outer ring, the inner and outer rings both being formed at least in the facing surface of the second panel such that the inner and outer rings are visible at least from the facing surface of the second panel, wherein:

said inner ring is comprised of a series of perforations and said outer ring is comprised of a series of perforations in which the perforations of said inner ring are staggered from the perforations of said outer ring such that at least some of the perforations of said inner ring each is disposed across an adjacent section of said strip directly from a space between two adjacent perforations of the outer ring as viewed at least from the facing surface of the second panel; and the blister aperture and the inner ring are aligned when the facing surface of the second panel is secured to the first panel.

7. The packaging blank of claim 6, wherein said first panel and said second panel are connected by a foldable score line.

8. A blister package housing comprising:

a packaging blank as claimed in claim 6;

a blister pack comprising a blister; and securing means, wherein:

said blister is aligned with the blister aperture of said first panel;

said first panel and said second panel are secured to one another by said securing means; and said blister pack is secured in between the first panel and the second panel.

9. The blister card package housing of claim 8, wherein the first and second panels are secured together by full-card heat sealing.

10. The blister card package housing of claim 9, wherein the inner ring defines a punch tab that is at least partially removable from the second panel, and the punch tab is secured to the blister pack.

11. A packaging blank comprising:

a first panel including a blister aperture; and a second panel having a facing surface and including an inner ring and an outer ring, the inner ring being positioned within the outer ring in a substantially concentric arrangement such that the inner and outer rings respectively include straight sections which are disposed side by side with each other, the inner and outer rings both being formed at least in the facing surface of the second panel such that the inner and outer rings are visible at least from the facing surface of the second panel, wherein:

said inner ring is comprised of a series of perforations and said outer ring is comprised of a series of perforations in which the perforations of said inner ring are staggered from the perforations of said outer ring such that each of the perforations in the straight section of said inner ring is aligned transversely of said straight sections with a space between two adjacent perforations in the straight section of the outer ring as viewed at least from the facing surface of the second panel; and the blister aperture and the inner ring are aligned when the facing surface of the second panel is secured to the first panel.

12. The packaging blank of claim 11, herein said first panel and said second panel are connected by a foldable score line.

13. A blister package housing comprising:

a packaging blank as claimed in claim 11;

a blister pack comprising a blister; and securing means, wherein:

said blister is aligned with the blister aperture of said first panel;

said first panel and said second panel are secured to one another by said securing means; and said blister pack is secured in between the first panel and the second panel.

14. The blister card package housing of claim 13, wherein the first and second panels are secured together by full-card heat sealing.

15. The blister card package housing of claim 14, wherein the inner ring defines a punch tab that is at least partially removable from the second panel, and the punch tab is secured to the blister pack.

* * * * *